US010920981B2

(12) United States Patent
Miyazaki et al.

(10) Patent No.: US 10,920,981 B2
(45) Date of Patent: Feb. 16, 2021

(54) BURNER HEAD FOR EXHAUST GAS PROCESSING APPARATUS, MANUFACTURING METHOD OF THE SAME, COMBUSTION CHAMBER FOR EXHAUST GAS PROCESSING APPARATUS, AND MANUFACTURING METHOD AND MAINTENANCE METHOD OF THE SAME

(71) Applicant: EBARA CORPORATION, Tokyo (JP)

(72) Inventors: Kazutomo Miyazaki, Tokyo (JP); Tetsuo Komai, Tokyo (JP); Seiji Kashiwagi, Tokyo (JP); Kazumasa Hosotani, Tokyo (JP); Takeshi Eda, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 92 days.

(21) Appl. No.: 16/326,251

(22) PCT Filed: Aug. 18, 2017

(86) PCT No.: PCT/JP2017/029588
§ 371 (c)(1),
(2) Date: Feb. 18, 2019

(87) PCT Pub. No.: WO2018/034331
PCT Pub. Date: Feb. 22, 2018

(65) Prior Publication Data

US 2019/0212007 A1 Jul. 11, 2019

(30) Foreign Application Priority Data

Aug. 19, 2016 (JP) ..... JP2016-161017
Aug. 10, 2017 (JP) ..... JP2017-155275

(51) Int. Cl.
*C10L 10/00* (2006.01)
*F23G 7/06* (2006.01)
(Continued)

(52) U.S. Cl.
CPC ..... *F23G 7/06* (2013.01); *F23D 14/20* (2013.01); *F23D 14/24* (2013.01); *F23D 14/50* (2013.01);
(Continued)

(58) Field of Classification Search
CPC ..... F23G 7/06; F23D 14/20
See application file for complete search history.

(56) References Cited

U.S. PATENT DOCUMENTS 3,838,974 A 10/1974 Hemsath et al.
4,218,426 A 8/1980 Dahmen
(Continued)

FOREIGN PATENT DOCUMENTS

CN 205481038 U 8/2016
EP 1 517 083 A1 3/2005
(Continued)

OTHER PUBLICATIONS

International Search Report Issued in Patent Application No. PCT/JP2017/029588 dated Oct. 17, 2017.
(Continued)

*Primary Examiner* — Jason Lau
(74) *Attorney, Agent, or Firm* — Pearne & Gordon LLP

(57) ABSTRACT

A burner head that constitutes a combustion chamber for an exhaust gas processing apparatus by being attached to an upper portion of a combustion chamber main body is provided. The burner head includes a chassis which has a cylindrical portion having a lower opening and in which a fastening module for removably fastening to the combustion chamber main body is provided, a fuel nozzle that blows fuel into the cylindrical portion, a combustion supporting gas nozzle that blows combustion supporting gas into the cylindrical portion, a processing gas nozzle that blows processing
(Continued)

gas into the cylindrical portion, and a pilot burner that ignites the fuel and/or the combustion supporting gas.

15 Claims, 40 Drawing Sheets

(51) Int. Cl.

| | |
|---|---|
| ***F23D 14/24*** | (2006.01) |
| ***F23D 14/20*** | (2006.01) |
| ***F23D 14/50*** | (2006.01) |
| ***F23D 14/62*** | (2006.01) |
| ***F23G 5/12*** | (2006.01) |
| *F23D 14/32* | (2006.01) |

(52) U.S. Cl.
CPC ..... *F23D 14/62* (2013.01); *F23G 5/12* (2013.01); *F23D 14/32* (2013.01)

(56) References Cited

U.S. PATENT DOCUMENTS

| | | | | |
|---|---|---|---|---|
| 4,240,785 | A * | 12/1980 | Crawford | F23G 5/32 431/352 |
| 4,861,262 | A | 8/1989 | Gitman et al. | |
| 5,328,354 | A * | 7/1994 | McGrath | F23G 5/50 431/5 |
| 6,234,787 | B1 | 5/2001 | Endoh et al. | |
| 2003/0024806 | A1 * | 2/2003 | Foret | C01B 3/22 204/164 |
| 2003/0054299 | A1 | 3/2003 | Kawamura et al. | |
| 2005/0064353 | A1 | 3/2005 | Wiesenberg et al. | |
| 2008/0095675 | A1 | 4/2008 | Hartung | |
| 2008/0131334 | A1 | 6/2008 | Kawamura et al. | |
| 2014/0106282 | A1 | 4/2014 | Kim et al. | |
| 2017/0059255 | A1 * | 3/2017 | Choi | F28D 17/04 |
| 2018/0051878 | A1 | 2/2018 | Miyazaki et al. | |

FOREIGN PATENT DOCUMENTS

| | | | | |
|---|---|---|---|---|
| EP | 2 132 485 | | | 12/2009 |
| EP | 2 463 579 | A1 | | 6/2012 |
| JP | H10-54515 | A | | 2/1998 |
| JP | H10-54534 | A | | 2/1998 |
| JP | 2005-083745 | A | | 3/2005 |
| JP | 2006046476 | A | * | 2/2006 |
| JP | 2007-263554 | A | | 10/2007 |
| JP | 2008-514388 | A | | 5/2008 |
| JP | 4937886 | B2 | | 5/2012 |
| JP | 2014-081188 | A | | 5/2014 |
| JP | 5977419 | B1 | | 8/2016 |
| WO | 2008-122819 | A1 | | 10/2008 |

OTHER PUBLICATIONS

Written Opinion Issued in Patent Application No. PCT/JP2017/029588 dated Oct. 17, 2017.
Chinese Office Action issued in Patent Application No. 201780050830.7 dated Aug. 29, 2019.
Partial Supplementary European Search Report issued in European Patent Application No. EP 17 84 1553.5 dated Feb. 6, 2020.
Office Action issued in Chinese Patent Application No. 201780050830.7 dated Mar. 24, 2020.

* cited by examiner

1

100

11a

BURNER HEAD FOR EXHAUST GAS PROCESSING APPARATUS, MANUFACTURING METHOD OF THE SAME, COMBUSTION CHAMBER FOR EXHAUST GAS PROCESSING APPARATUS, AND MANUFACTURING METHOD AND MAINTENANCE METHOD OF THE SAME

TECHNICAL FIELD

The present disclosure relates to a burner head for an exhaust gas processing apparatus and a manufacturing method thereof. Further, the present disclosure relates to a combustion chamber for an exhaust gas processing apparatus, and a manufacturing method and a maintenance method thereof.

BACKGROUND ART

From a semiconductor manufacturing device, gas containing harmful combustible gas such as silane gas ($SiH_4$) or halogen based gas ($NF_3$, $ClF_3$, $SF_6$, $CHF_3$, $C_2F_6$, and $CF_4$) is exhausted. However, such exhaust gas (processing gas) cannot be discharged to the atmosphere as is. Therefore, in general, such exhaust gas is introduced to a detoxifying apparatus, and oxidation/detoxification treatment by combustion is performed on the exhaust gas. As a treatment method, a combustion-type exhaust gas processing apparatus that performs exhaust gas processing by forming a flame in a furnace by using fuel gas is widely used.

CITATION LIST

Patent Literature

Patent Literature 1: Japanese Patent No. 4937886

SUMMARY OF PROBLEM

Technical Problem

In such an exhaust gas processing apparatus, dust occurs, so that periodical maintenance is required.

The present disclosure is made in view of the above problem, and an object of the disclosure is to provide a burner head for realizing an exhaust gas processing apparatus that can be easily maintained, a manufacturing method of the burner head, a combustion chamber for an exhaust gas processing apparatus having such a burner head, a manufacturing method of the combustion chamber, and a maintenance method of the combustion chamber.

Solution to Problem

According to a present disclosure, provided is a burner head that constitutes a combustion chamber for an exhaust gas processing apparatus by being attached to an upper portion of a combustion chamber main body, the burner head comprising: a chassis which comprises a cylindrical portion with a lower opening, a fastening module for removably fastening to the combustion chamber main body being provided in the chassis; a fuel nozzle that blows fuel into the cylindrical portion; a combustion supporting gas nozzle that blows combustion supporting gas into the cylindrical portion; a processing gas nozzle that blows processing gas into the cylindrical portion; and a pilot burner that ignites the fuel and/or the combustion supporting gas.

Preferably, the fuel nozzle, the combustion supporting gas nozzle, and the processing gas nozzle are located on an identical plane perpendicular to an axis line of the cylindrical portion. Here, a state where the nozzles are located on the same plane means a state where some of the openings of the three nozzles on an inner circumferential surface of the combustion chamber are located on the same plane.

Preferably, a side surface of the cylindrical portion is provided with a first opening to which the fuel nozzle is connected, a second opening to which the combustion supporting gas nozzle is connected, and a third opening to which the processing gas nozzle is connected, and at least a part of the first opening, at least apart of the second opening, and at least apart of the third opening are located on an identical plane perpendicular to an axis line of the cylindrical portion.

Preferably, a side surface of the cylindrical portion is provided with a third opening to which the processing gas nozzle is connected, and the third opening has a slit-like shape extending in a longitudinal direction of the cylindrical portion.

Preferably, the pilot burner is removable from the cylindrical portion.

Preferably, the cylindrical portion is provided with a hole which opens upward and into which a heater can be inserted.

Preferably, the fastening module is welded to the chassis.

Preferably, the fuel nozzle, the combustion supporting gas nozzle, and the processing gas nozzle are welded to the cylindrical portion.

Preferably, the cylindrical portion is composed of a thick pipe.

Preferably, the chassis comprises the cylindrical portion and an annular portion fitted to the cylindrical portion, and the fastening module projects outward from a side surface of the annular portion.

Preferably, the burner head further comprising: a purge gas nozzle that blows purge gas into the cylindrical portion.

Preferably, the chassis comprises the cylindrical portion and an annular portion fitted to the cylindrical portion, and the purge gas nozzle blows the purge gas into the cylindrical portion through an opening of the annular portion.

Preferably, the fuel, the combustion supporting gas, and the processing gas are blown toward a tangential direction of an inner circumferential surface of the cylindrical portion.

According to another embodiment of the present disclosure, provided is a combustion chamber for an exhaust gas processing apparatus, the combustion chamber comprising: a combustion chamber main body; and the burner head which is removably fastened to an upper portion of the combustion chamber main body.

According to another embodiment of the present disclosure, provided is a maintenance method of the combustion chamber, the maintenance method comprising: removing the burner head from the combustion chamber main body; and fastening a new burner head to the combustion chamber main body.

According to another embodiment, provided is a manufacturing method of a combustion chamber for an exhaust gas processing apparatus, the manufacturing method comprising: removably fastening the burner head to an upper portion of the combustion chamber main body.

According to another embodiment, provided is a manufacturing method of a burner head that constitutes a combustion chamber for an exhaust gas processing apparatus by being attached to an upper portion of a combustion chamber main body, the manufacturing method comprising: welding a fastening module for removably fastening to the combustion chamber main body, a fuel nozzle that blows fuel into a chassis, a combustion supporting gas nozzle that blows combustion supporting gas into the chassis, and a processing gas nozzle that blows processing gas into the chassis to the chassis.

According to another embodiment, provided is a manufacturing method of a burner head that constitutes a combustion chamber for an exhaust gas processing apparatus by being attached to an upper portion of a combustion chamber main body, the manufacturing method comprising: forming, by casting, a cylindrical portion, a processing gas nozzle being connected to a first opening provided in a side surface of the cylindrical portion; forming, by machining, a second opening and a third opening in the side surface of the cylindrical portion; and attaching a fuel nozzle that blows fuel into the cylindrical portion to the second opening and attaching a combustion supporting gas nozzle that blows combustion supporting gas into the cylindrical portion to the third opening by welding.

Preferably, upon forming the cylindrical portion, a projection is formed on an inner surface of the cylindrical portion, and upon forming the second opening and the third opening, a drill is caused to penetrate from an outer surface of the cylindrical portion to the projection.

Advantageous Effects of Invention

The combustion chamber of the exhaust gas processing apparatus can be easily maintained.

DESCRIPTION OF EMBODIMENTS

Hereinafter, an embodiment will be described with reference to the drawings.

Figure 1:
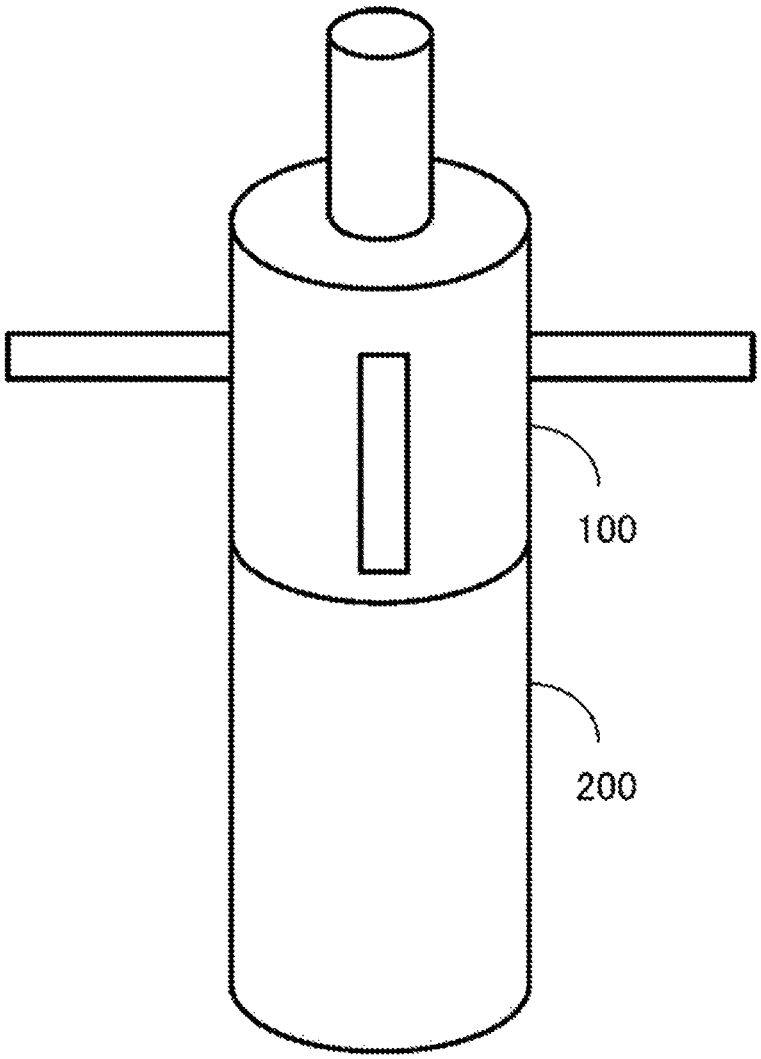
FIG. 1 is a schematic diagram of a combustion chamber 1 for an exhaust gas processing apparatus.

FIG. 1 is a schematic diagram of a combustion chamber 1 for an exhaust gas processing apparatus. In the embodiment, the combustion chamber 1 includes a burner head 100 and a combustion chamber main body 200. The burner head 100 can be attached to and detached from the combustion chamber main body 200. The combustion chamber 1 is manufactured by fastening the burner head 100 to an upper portion of the combustion chamber main body 200. An exhaust gas (processing gas) is detoxified by burning the exhaust gas in the combustion chamber 1.

By dividing the combustion chamber 1 into the burner head 100 and the combustion chamber main body 200, the entire length of the combustion chamber 1 can be reduced and the combustion chamber 1 can be easily manufactured as compared with a case where the combustion chamber 1 is formed of one member. Even when dust or the like is accumulated on an upper inside wall of the combustion chamber 1, the combustion chamber 1 can be easily maintained by removing the burner head 100 from the combustion chamber main body 200 and fastening a new burner head 100 to the combustion chamber main body 200.

Figure 2:
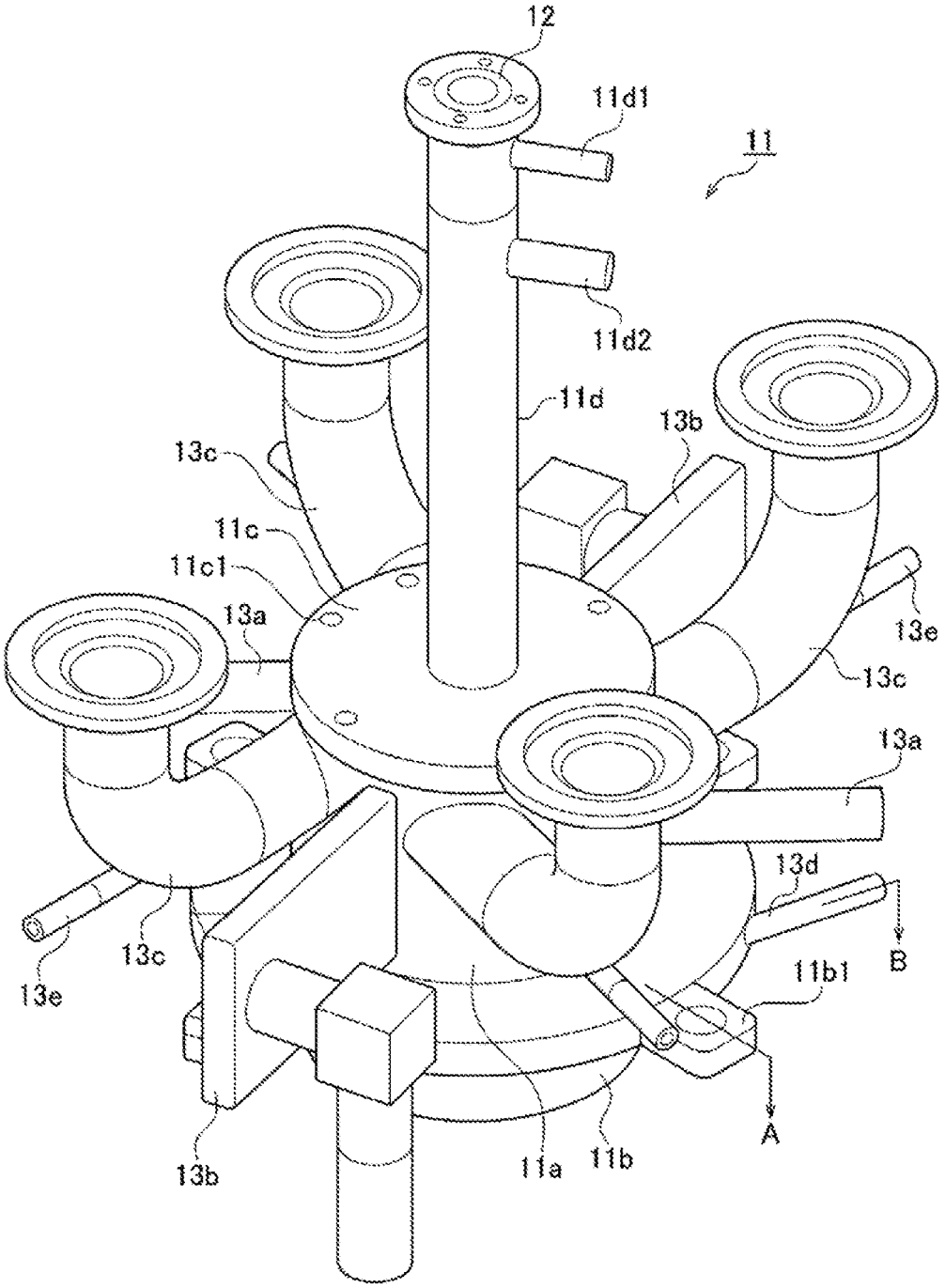
FIG. 2 is a perspective view of a burner head 100.

FIG. 2 is a perspective view of the burner head 100. The burner head 100 has a chassis 11, a pilot burner 12 for ignition, fuel nozzles 13*a*, combustion supporting gas nozzles 13*b*, processing gas nozzles 13*c*, and a purge gas nozzle 13*d*.

In FIG. 2 and the following example, the burner head 100 is provided with two fuel nozzles 13*a*, two combustion supporting gas nozzles 13*b*, and four processing gas nozzles 13*c*. More specifically, one fuel nozzle 13*a* or one combustion supporting gas nozzle 13*b* is arranged between two adjacent processing gas nozzles 13*c*. When a fuel flow rate and a combustion supporting gas flow rate are determined at an air ratio of, for example, about 1.3, the flow rate of the fuel nozzle 13*a* is about 1/15 of the combustion supporting gas flow rate, so that the fuel nozzle 13*a* can be formed of a relatively thin pipe. The combustion supporting gas nozzle 13*b* can be composed of a vertically long pipe so as to ensure uniform flow in a tangential direction with inner wall to prevent product materials from adhering to the inner wall. The processing gas nozzle 13*c* may be closed by adhesion of sublimable product, so that the processing gas nozzle 13*c* can be composed of a relatively thick pipe. The processing gas nozzle 13*c* described above is only an example, and the numbers, shapes, and installation positions of the fuel nozzles 13*a*, the combustion supporting gas nozzles 13*b*, and the processing gas nozzles 13*c* are not particularly limited.

The chassis 11 is composed of a cylindrical portion 11*a* having an upper opening and a lower opening, an annular portion 11*b* fitted to a lower portion of the cylindrical portion 11*a*, a ceiling module 11*c* which is provided to the upper opening of the cylindrical portion 11*a* and whose center portion is opened, and a projecting module 11*d* which projects upward from the opening of the ceiling module 11*c*. These components may be integrated with each other, or may be a plurality of members that can be attached to and detached from each other.

An opening is provided to a side surface of the chassis 11 (more specifically, the cylindrical portion 11*a*), and fuel, combustion supporting gas, and processing gas are blown into the chassis 11 through the fuel nozzle 13*a*, the combustion supporting gas nozzle 13*b*, and the processing gas nozzle 13*c*, respectively. The processing gas introduction nozzle 13*c* is provided with a processing gas nozzle purge gas introduction nozzle 13*e* for blowing gas and product materials remaining in a processing gas introduction nozzle portion before ignition.

Figure 3A:
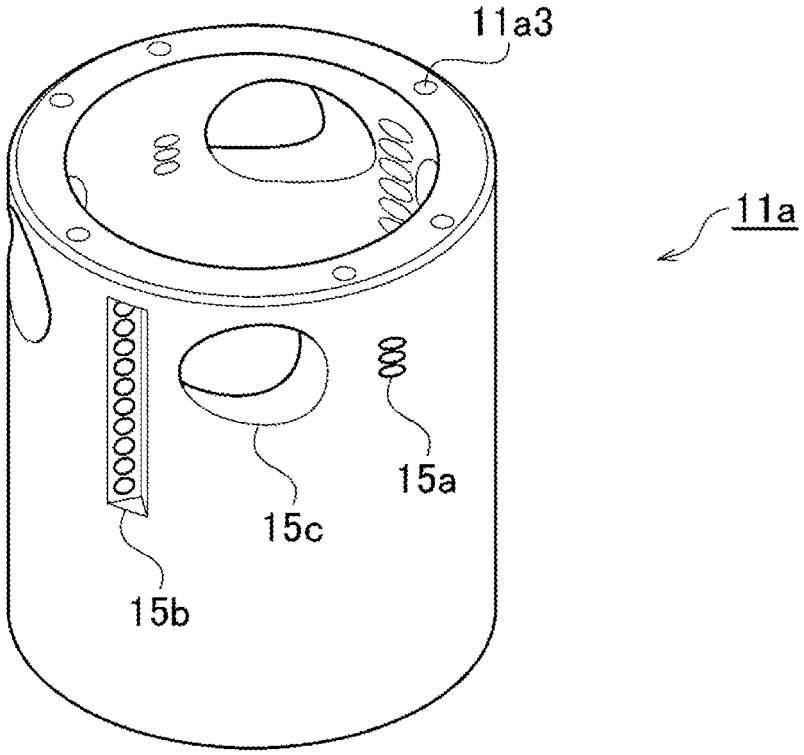
FIG. 3A is a perspective view of a cylindrical portion 11*a*.
Figure 3B:
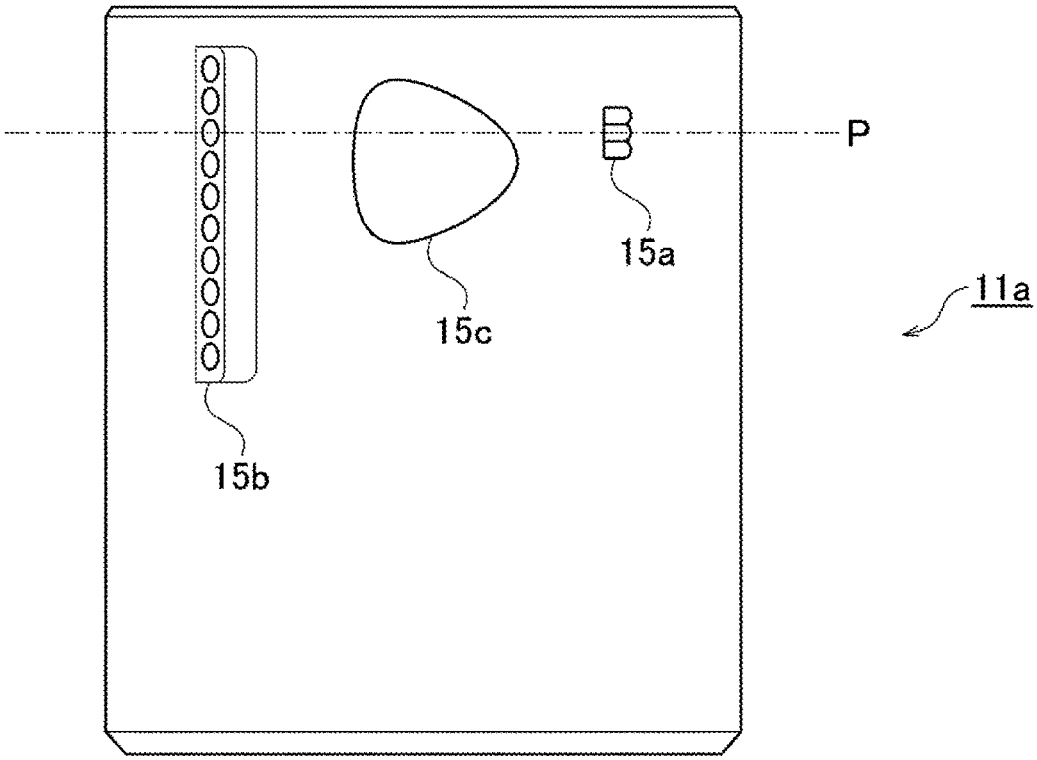
FIG. 3B is a side view of the cylindrical portion 11*a*.

FIGS. 3A and 3B are a perspective view and a side view of the cylindrical portion 11*a*, respectively. The cylindrical portion 11*a* is formed of, for example, a thick pipe with a thickness of about 10 mm and an inner diameter of about 70 mm. By using the thick pipe, it is possible to form holes 11*a*3 opening upward from the cylindrical portion 11*a*, and a cartridge heater (not shown in the drawings) can be inserted.

To raise inner surface temperature of a stainless-steel pipe to prevent adhesion of sublimable product, a jacket heater is generally used from outside of the pipe. However, by directly warming the thick pipe by the cartridge heater, the thick pipe can be more efficiently warmed than when using the jacket heater, so that it contributes to energy saving. It is also possible to raise temperature of a burner head having a complicated shape. Further, the cartridge heater is more inexpensive than the jacket heater, so that cost reduction is achieved.

Openings 15*a* to 15*c* connected to the fuel nozzle 13*a*, the combustion supporting gas nozzle 13*b*, and the processing gas nozzle 13*c*, respectively, are provided to the side surface of the cylindrical portion 11*a*. It is desirable that at least some of the openings 15*a* to 15*c* are located on the same plane (indicated by a chain line P in FIG. 3B) perpendicular to an axis line of the cylindrical portion 11*a*.

The numbers and the shapes of the openings 15*a* to 15*c* correspond to those of the fuel nozzles 13*a*, the combustion supporting gas nozzles 13*b*, and the processing gas nozzles 13*c*. Blowing outlet diameters (openings) are designed so that momenta of blowing-out velocities of the fuel and the combustion supporting gas are substantially the same. In the examples shown in FIGS. 3A and 3B, the openings 15*a* for the fuel can be formed from, for example, a set of three small holes with a diameter of about 2 mm aligned in a vertical direction. The openings 15*b* for the combustion supporting gas can be formed from, for example, a set of ten small holes with a diameter of about 4 mm aligned in the vertical direction. The opening 15*c* for the processing gas can be formed from one hole with a diameter of about 25 mm.

Figure 3C:
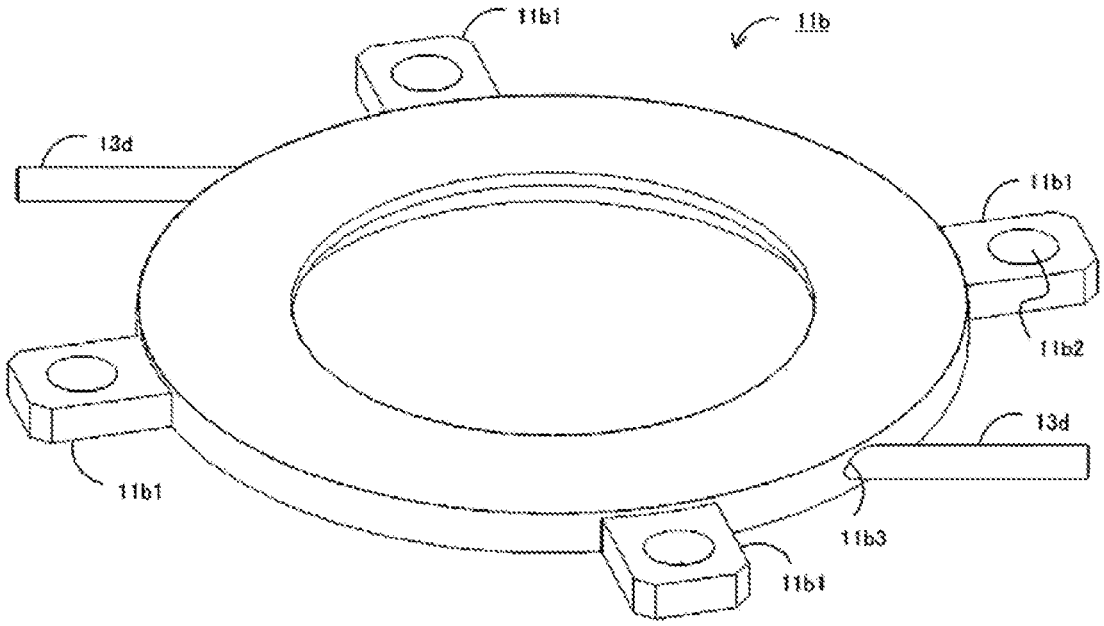
FIG. 3C is a perspective view of an annular portion 11*b*.
Figure 3D:
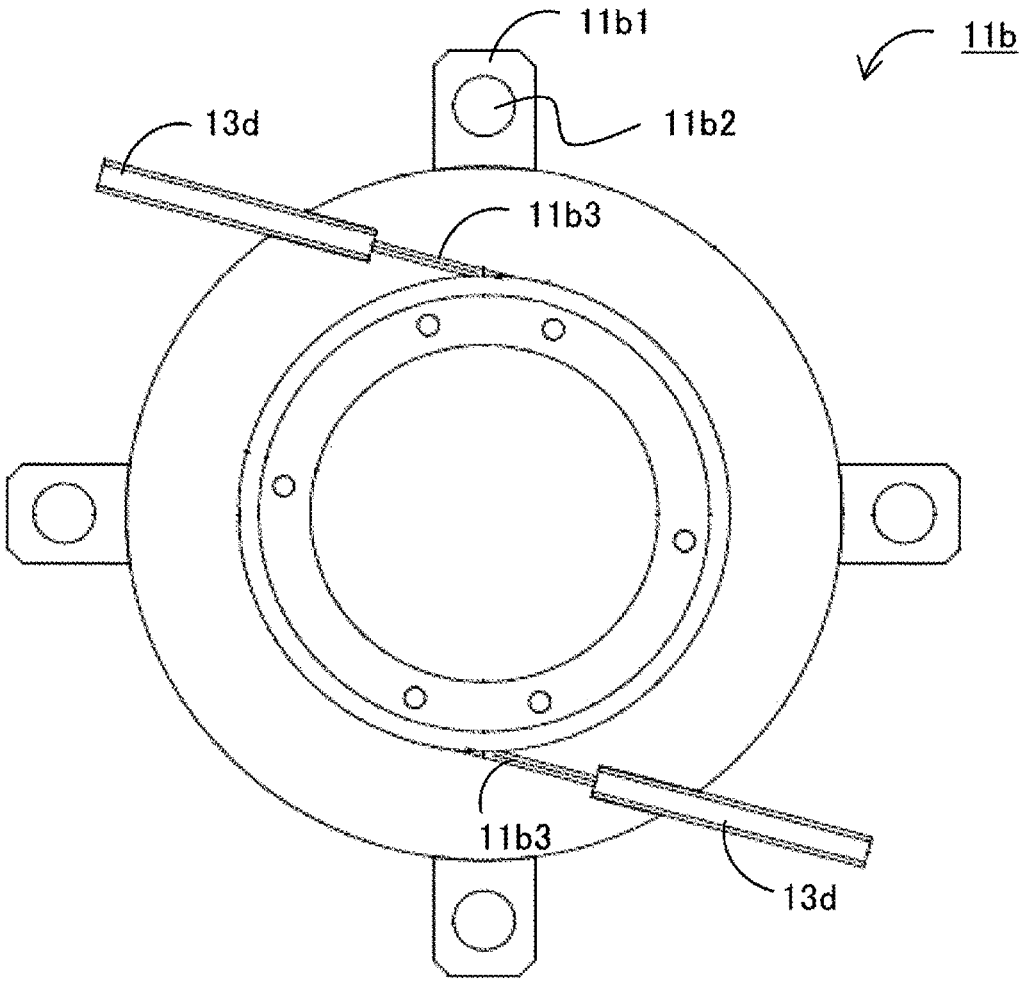
FIG. 3D is a horizontal cross-sectional view passing through a vertical center of the annular portion lib in FIG. 3C.

FIG. 3C is a perspective view of the annular portion lib. FIG. 3D is a horizontal cross-sectional view passing through a vertical center of the annular portion 11*b* in FIG. 3C. The annular portion 11*b* is provided by welding with one or a plurality of fastening modules 11*b*1 (in FIG. 3D, four fastening modules 11*b*1 at equal intervals) that project outward from the side surface by about 10 mm. The fastening module 11*b*1 is provided with an opening 11*b*2, and can be fastened to the combustion chamber main body 200 with a bolt as described later.

Further, the annular portion 11*b* is provided with two openings 11*b*3 facing inside from the side surface. Each of the openings 11*b*3 is attached with the purge gas nozzle 13*d*. The purge gas nozzle 13*d* faces in a tangential direction of an inner circumferential surface of the cylindrical portion 11*a*.

Figure 4:
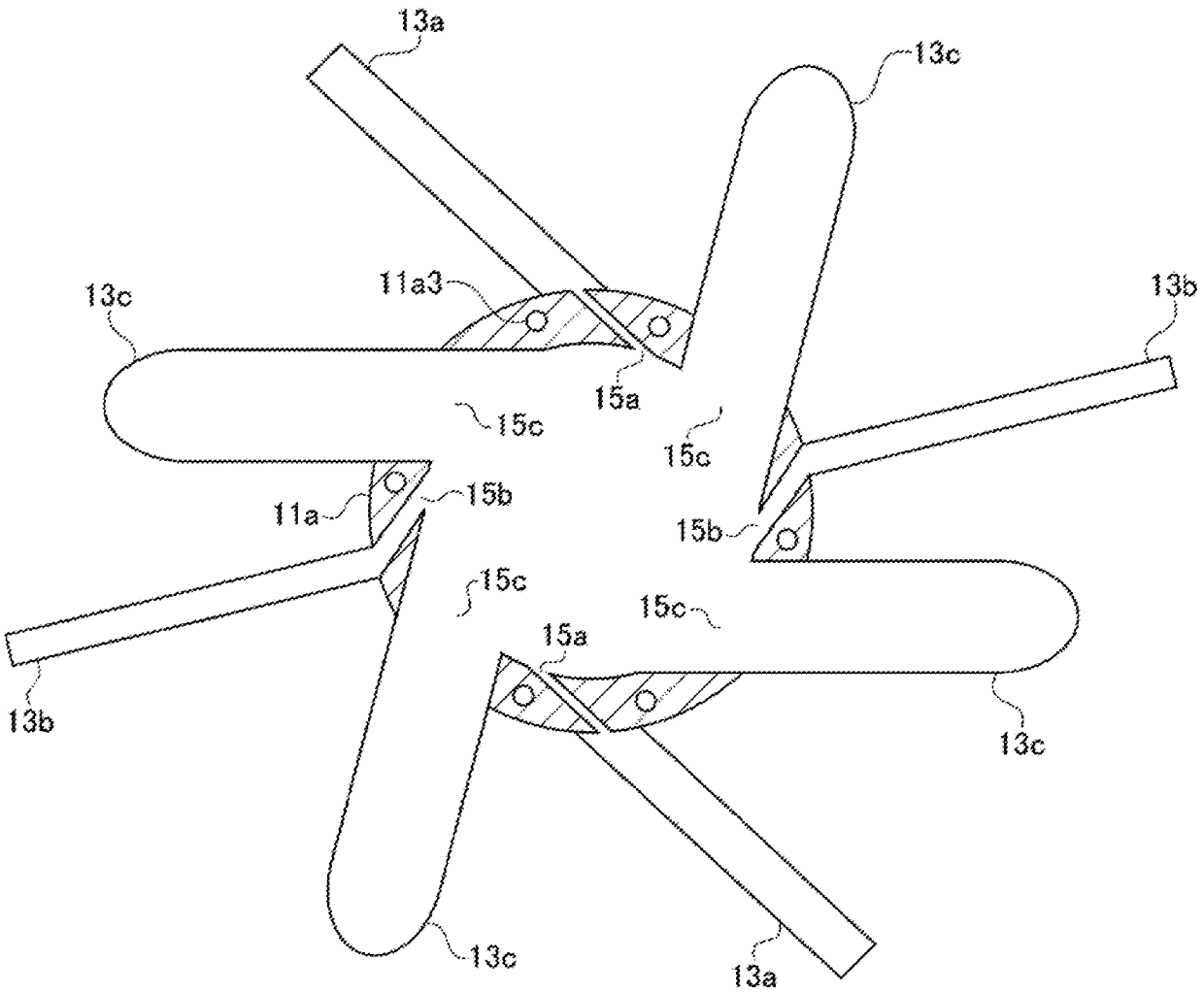
FIG. 4 is a horizontal cross-sectional view passing through fuel nozzles 13*a*, combustion supporting gas nozzles 13*b*, and processing gas nozzles 13*c* in the burner head 100 shown in FIG. 2.

FIG. 4 is a horizontal cross-sectional view passing through the fuel nozzles 13*a*, the combustion supporting gas nozzles 13*b*, and the processing gas nozzles 13*c* in the burner head 100 shown in FIG. 2. As shown in FIG. 4, two fuel nozzles 13*a*, two combustion supporting gas nozzles 13*b*, and four processing gas nozzles 13*c* are respectively attached to positions of the openings 15*a* to 15*c* provided in the side surface of the cylindrical portion 11*a*. At least some of the openings 15*a* to 15*c* are located on the same plane, so that it can be said that the fuel nozzles 13*a*, the combustion supporting gas nozzles 13*b*, and the processing gas nozzles 13*c* are also located on the same plane.

The fuel nozzles 13*a*, the combustion supporting gas nozzles 13*b*, and the processing gas nozzles 13*c* face in a tangential direction (or a direction a little tilted from the tangential direction, the same applies hereinafter) of the inner circumferential surface of the cylindrical portion 11*a*. When the cylindrical portion 11*a* has a thickness of about 10 mm, the fuel, the combustion supporting gas, and the processing gas, whose inlet lengths can be secured in the cylindrical portion 11*a* and which are rectified, are supplied in the tangential direction of the cylindrical portion 11*a*.

Figure 5:
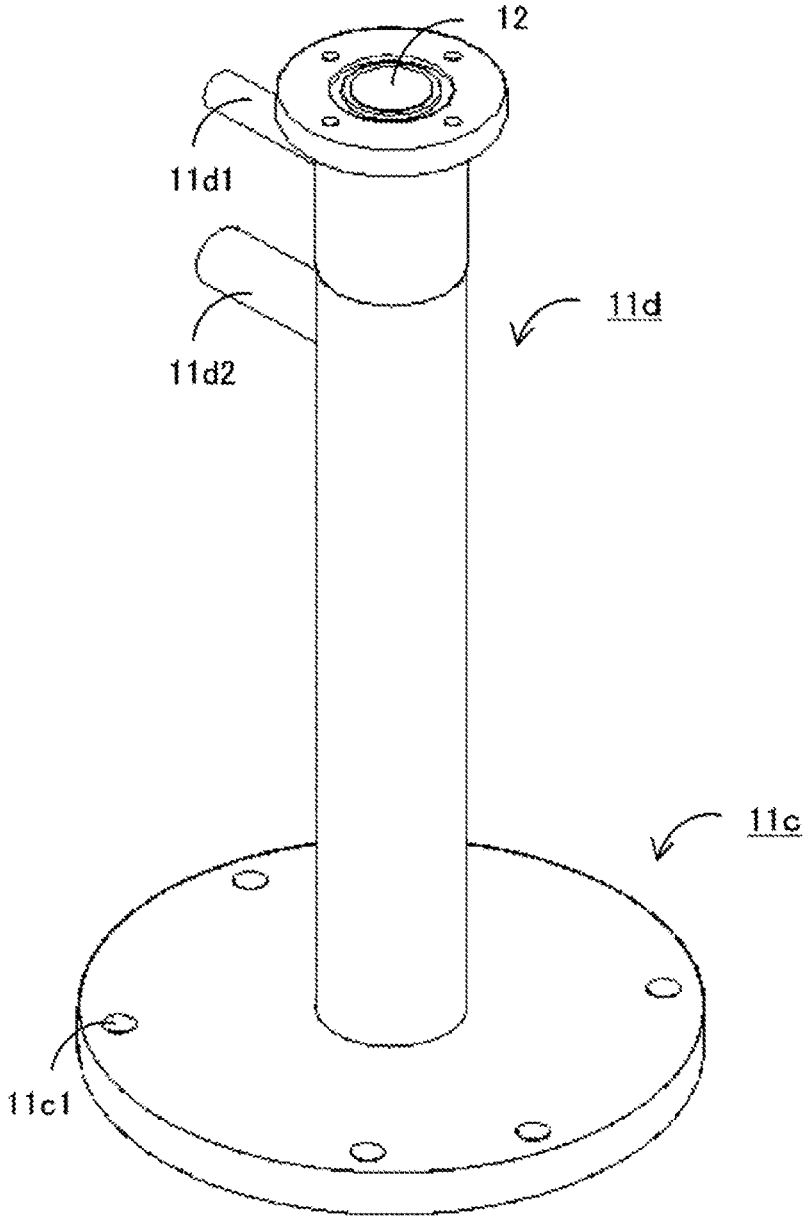
FIG. 5 is a perspective view of a ceiling module 11*c* and a projecting module 11*d*.

FIG. 5 is a perspective view of the ceiling module 11*c* and the projecting module 11*d*. In the projecting module 11*d*, the pilot burner 12 that ignites the fuel and/or the combustion supporting gas is arranged. Two openings (not shown in the drawings) are provided in the side surface of the projecting module 11*d*. A fuel supply nozzle 11*d*1 communicates with inside of the projecting module 11*d* through the upper opening, and the fuel is supplied through the upper opening. Further, an air supply nozzle 11*d*2 communicates with inside of the projecting module 11*d* through the lower opening, and the air is supplied through the lower opening. It is desirable that the pilot burner 12 can be removed from the cylindrical portion 11*a* by making the ceiling module 11*c* removable from the cylindrical portion 11*a* or making the projecting module 11*d* removable from the ceiling module 11*c*.

One or a plurality of holes 11*c*1 is formed in the ceiling module 11*c*. The holes 11*c*1 are provided at positions corresponding to the holes 11*a*3 (see FIG. 3A) in the cylindrical portion 11*a*. The cartridge heater can be inserted into the holes 11*a*3 as described above through the holes 11*c*1.

Figure 6:
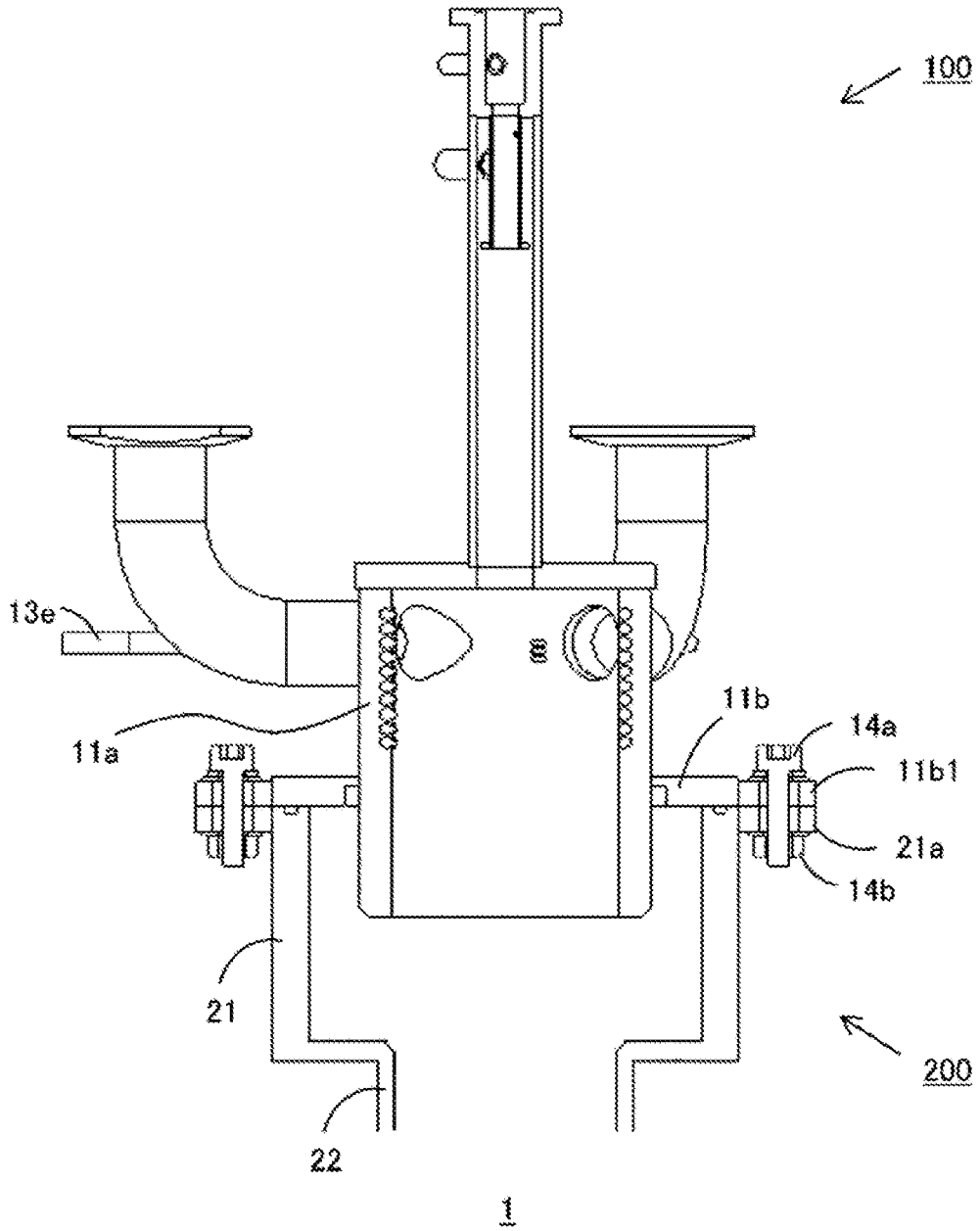
FIG. 6 is a vertical cross-sectional view (A cross-section) of the combustion chamber 1 including a fastening module 11*b*1 in FIG. 2.

FIG. 6 is a vertical cross-sectional view (A cross-section) of the combustion chamber 1 including the fastening module 11*b*1 in FIG. 2. The combustion chamber main body 200 has an upper cylindrical portion 21 that opens upward (to the burner head 100) and downward and a lower cylindrical portion 22 that extends downward from the lower opening of the upper cylindrical portion 21. These modules may be integrated with each other, or may be composed of a plurality of members.

The diameter of the upper cylindrical portion 21 is approximately equal to the diameter of the annular portion 11*b* of the burner head 100. The annular portion 11*b* is arranged on the upper cylindrical portion 21. A lower portion of the cylindrical portion 11*a* of the burner head 100 is located in the upper cylindrical portion 21 of the combustion chamber main body 200. The diameter of the lower cylindrical portion 22 is smaller than the diameter of the upper cylindrical portion 21 and is approximately equal to the diameter of the cylindrical portion 11*a* of the burner head 100.

A fastening module 21*a* extends outward from an upper end of the upper cylindrical portion 21. The fastening module 21*a* has an opening at a position facing an opening formed in the fastening module 11*b*1 of the burner head 100. The burner head 100 and the combustion chamber main body 200 can be fastened with each other by inserting a bolt 14*a* into the openings of the fastening modules 11*b*1 and 21*a* from upward (from the side of the burner head 100) and fitting a nut 14*b* into a lower portion of the bolt 14*a* from downward (from the side of the combustion chamber main body 200). Thereby, the burner head 100 and the combustion chamber main body 200 are integrated into one body, and the combustion chamber 1 having a cylindrical cavity inside thereof is configured.

Figure 7:
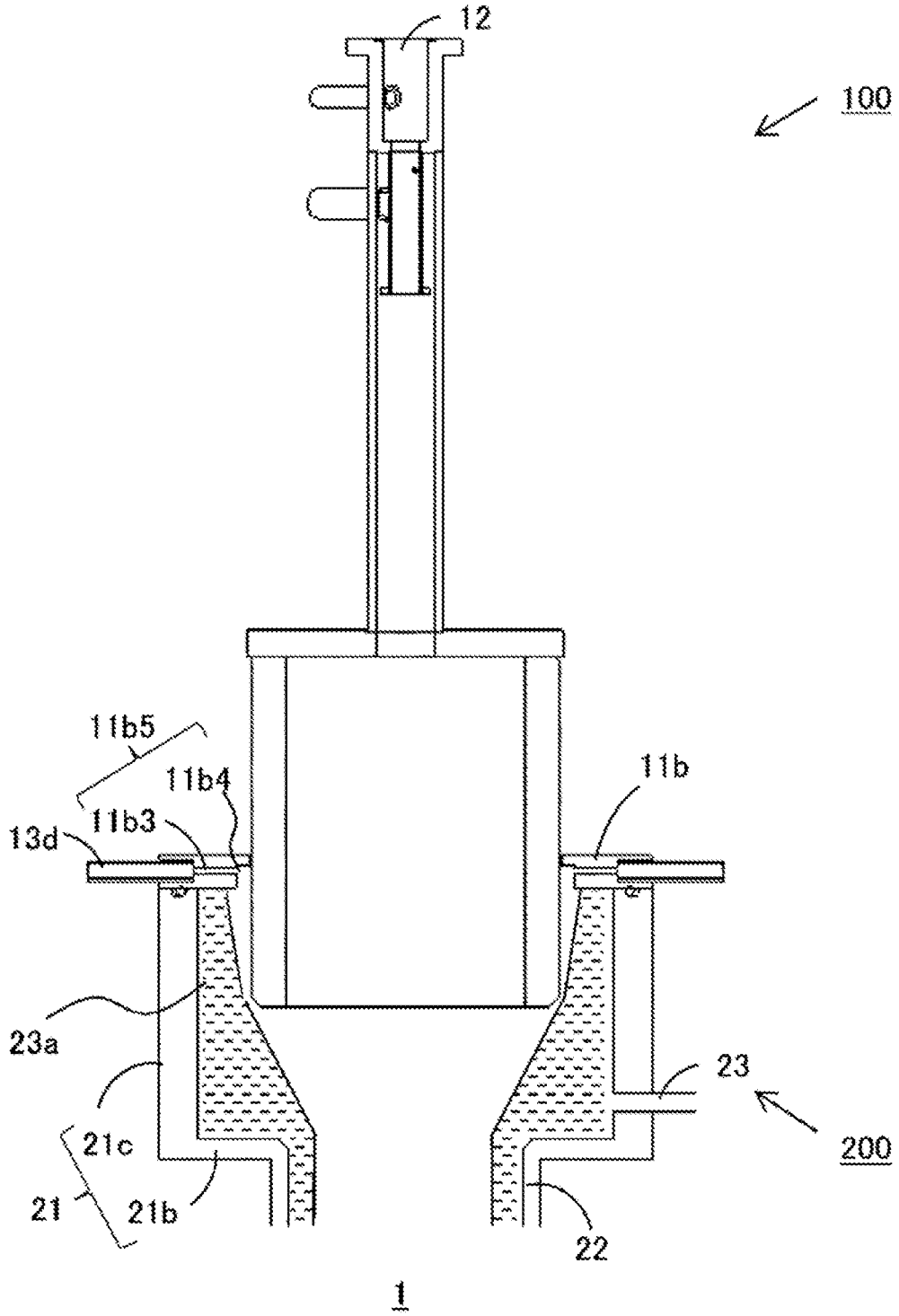
FIG. 7 is a vertical cross-sectional view (B cross-section) of the combustion chamber 1 including a purge gas nozzle 13*d* in FIG. 2.

FIG. 7 is a vertical cross-sectional view (B cross-section) of the combustion chamber 1 including the purge gas nozzle 13*d* in FIG. 2. A water supply nozzle 23 communicates with an opening provided in the side surface of the upper cylindrical portion 21 of the combustion chamber main body 200, and water is supplied into the upper cylindrical portion 21. The water supply nozzle 23 need not necessarily be on the same plane as that of the purge gas nozzle 13*d*.

The opening 11*b*3 formed in the annular portion lib is connected to a circular groove 11*b*4 opening downward. Therefore, puree gas from the purge gas nozzle 13*d* is supplied into the upper cylindrical portion 21 through the opening 11*b*3 and the circular groove 11*b*4.

When seeing the combustion chamber 1 as a whole, there is the pilot burner 12 in an uppermost position, there are the fuel nozzle 13*a*, the combustion supporting gas nozzle 13*b*, and the processing gas nozzle 13*c* (not shown in FIG. 7) below the pilot burner 12, there is the purge gas nozzle 13*d* below the nozzles mentioned above, and there is the water supply nozzle 23 below the purge gas nozzle 13*d*.

Hereinafter, the roles of the water supply nozzle 23 and the purge gas nozzle 13*d* will be described in detail.

As shown in FIG. 7, in the combustion chamber 1, the water supply nozzle 23 that supplies water for forming a wetted wall (water film) 23*a* on an inner wall surface of the combustion chamber 1 is installed in a position slightly below a position into which the fuel, the combustion supporting gas, and the processing gas are blown. More specifically, the water supply nozzle 23 is installed in the side wall of the upper cylindrical portion 21 of the combustion chamber main body 200. The water from the water supply nozzle 23 stays in the upper cylindrical portion 21, so that the upper cylindrical portion 21 can be called a water storage module.

The upper cylindrical portion 21 is composed of a ring-shaped bottom plate 21*b* that extends outward in the radial direction from the side surface of the lower cylindrical portion 22 and forms a bottom surface of the upper cylindrical portion 21 and a cylindrical side plate 21*c* that extends in substantially the vertical direction from the outer circumferential edge of the bottom plate 21*b* and forms the side wall of the upper cylindrical portion 21. The water supply nozzle 23 is fixed to the side plate 21*c*. The water supply nozzle 23 is arranged so as to eject water toward the tangential direction of the inner circumferential surface of the upper cylindrical portion 21.

The water is ejected from the water supply nozzle 23 toward the tangential direction of the inner circumferential surface of the upper cylindrical portion 21, so that in the upper cylindrical portion 21, a water film is formed which is composed of a swirling flow having a water surface inclined obliquely downward from the outside to the inside in the radial direction. Then, the water film flows down along the inner wall of the lower cylindrical portion 22 from a lower edge and a radial direction inner edge of the swirling flow (water film) having an inclined water surface, that is, from a radial direction inner edge of the bottom plate 21*b* of the upper cylindrical portion 21, and a wetted wall water 23*a* is formed on the inner wall of the combustion chamber 1 (this will be described later in detail).

A purge gas blowing module 11*b*5 composed of the circular groove 11*b*4 and the opening 11*b*3 is provided above the upper cylindrical portion 21. A plurality of purge gas nozzles 13*d* that blow purge gas are formed at intervals in a circumferential direction through the purge gas blowing module 11*b*5. The purge gas is blown from the purge gas nozzle 13*d* to the purge gas blowing module 11*b*5, and the purge gas is ejected downward from a lower end opening of the circular groove 11*b*4. Air or nitrogen can be used as the purge gas.

More specifically, the purge gas nozzle 13*d* that blows the purge gas is installed from the annular portion 11*b* toward the tangential direction (also see FIG. 3D), and by blowing the purge gas toward a tangential direction of an outer circumferential side surface of the circular groove 11*b*4, an entire circumference of the circular groove 11*b*4 is filled with the purge gas, and the purge gas annularly blows downward from an entire circumference of the lower end opening of the circular groove 11*b*4. By blowing the purge gas annularly from the circular groove 11*b*4, it is possible to replace a peripheral atmosphere in an upper edge portion of the wetted wall water 23*a* and an area near the upper edge portion (that is, an upper edge portion of the swirling flow (water film) of the water formed in the upper cylindrical portion 21 and an area near the upper edge portion) with the purge gas (air or nitrogen).

Figure 8A:
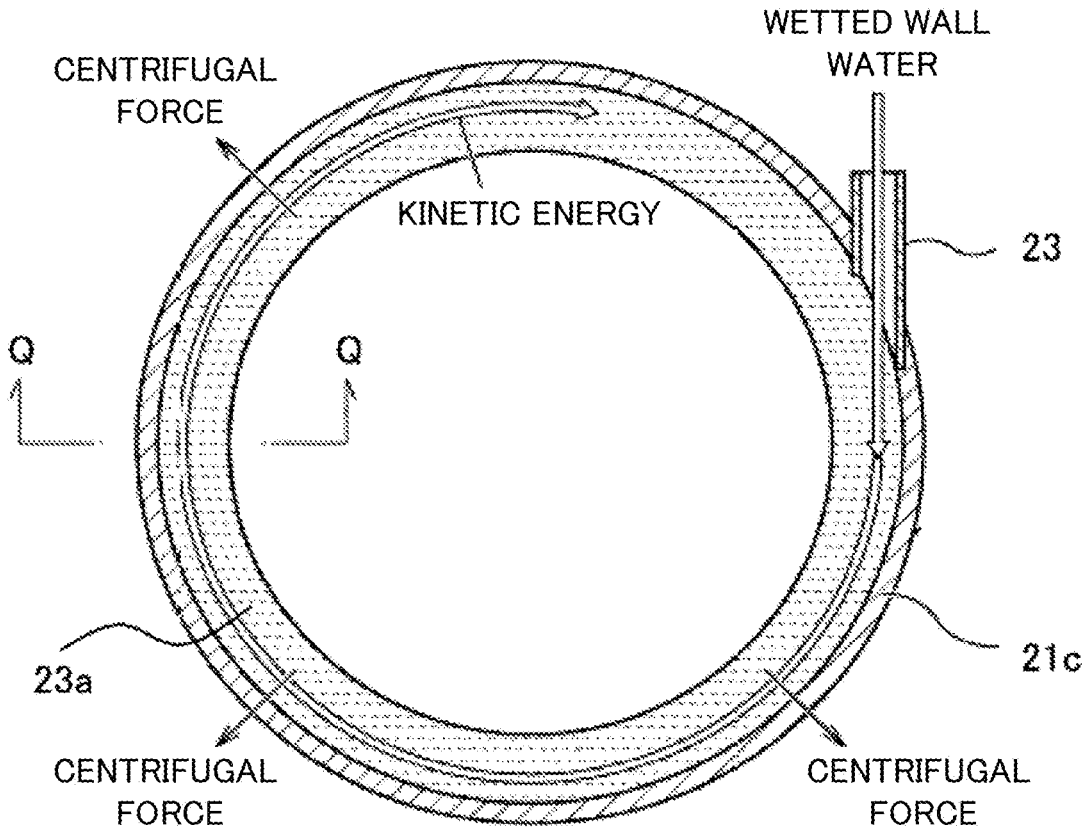
FIG. 8A is a horizontal direction cross-sectional view including a water supply nozzle 23 in FIG. 7.
Figure 8B:
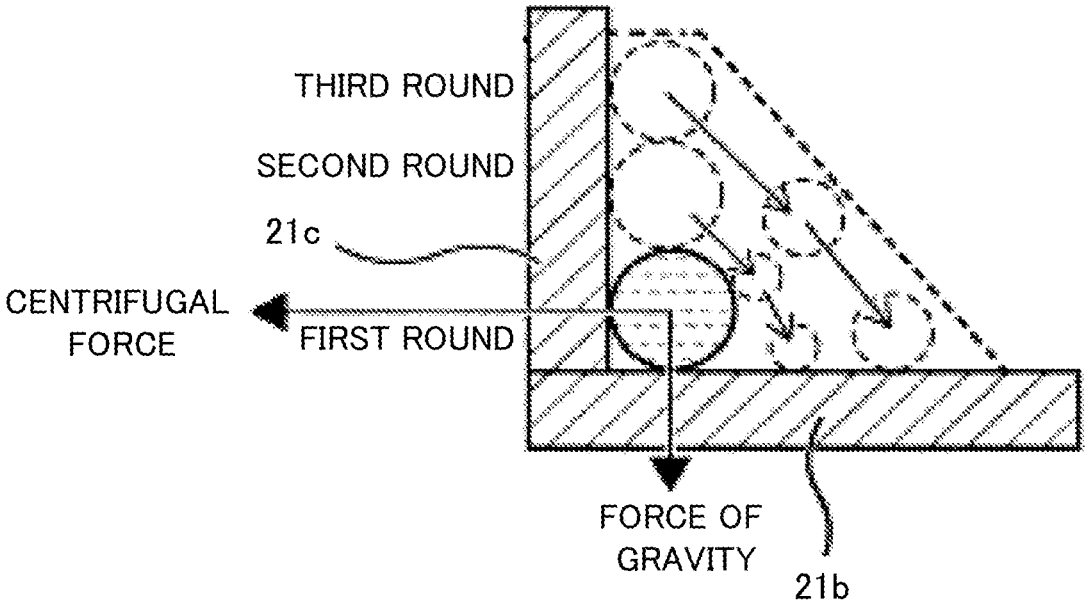
FIG. 8B is a Q-Q arrow view of FIG. 8A.

FIGS. 8A and 8B are diagrams showing a configuration for forming the swirling flow of the wetted wall water 23*a* in the upper cylindrical portion 21. More specifically, FIG. 8A is a horizontal direction cross-sectional view including the water supply nozzle 23 in FIG. 7 and FIG. 8B is a Q-Q arrow view of FIG. 8A.

As shown in FIG. 8A, the wetted wall water 23*a* is supplied at a certain flow velocity from the water supply nozzle 23 installed in a tangential direction of an inner circumference of the side plate 21*c* of the upper cylindrical portion 21 and flown along a wall surface inner circumference of the upper cylindrical portion 21 by its kinetic energy. The wetted wall water 23*a* moves on a circumference, so that a centrifugal force is applied to the wetted wall water 23*a*. Therefore, the wetted wall water 23*a* continues to move circularly along the wall surface of the side plate 21*c* as shown in FIG. 8B, and the water is continuously supplied, so that the wetted wall water 23*a* is pushed upward as the wetted wall water 23*a* continues to move circularly such as from a first round to a third round.

However, as the wetted wall water 23*a* continues to move circularly, the kinetic energy is reduced by friction, and at the same time, the centrifugal force is also reduced. Therefore, the water that is pushed upward flows down toward the inside of the circumference with the force of gravity. In this way, a water film is formed, from which water does not splash and which is not discontinued and is inclined obliquely downward from the outside to the inside in the radial direction. As shown in FIG. 7, the water film having the inclined water surface flows down along the inner wall of the lower cylindrical portion 22 from the inner edge of the bottom plate 21*b* of the upper cylindrical portion 21 and the wetted wall water 23*a* is formed on the inner wall of the combustion chamber 1.

It is possible to prevent solid objects from being stuck to the inner wall of the combustion chamber 1 by blowing the purge gas from the purge gas blowing module 11*b*5 at an appropriate flow rate.

In the combustion chamber 1 described above, the fuel, the combustion supporting gas, and the processing gas are blown from the fuel nozzle 13*a*, the combustion supporting gas nozzle 13*b*, and the processing gas nozzle 13*c*, respectively, toward the tangential direction of the inner circumferential surface of the combustion chamber 1 at a flow velocity higher than or equal to a flame combustion speed. Thereby, a three-type-mixed cylindrical mixed flame, which floats from the inner wall of the combustion chamber 1, is formed along an axial direction of the combustion chamber 1.

When blowing three types of gases in the tangential directions, a distribution is formed in which a low-temperature and heavy unburned three-type-mixed gas is located on the outside of the cylindrical mixed flame by a swirling centrifugal force and a high-temperature and light burned three-type-mixed gas is located inside the cylindrical mixed flame. Therefore, the cylindrical mixed flame is covered by the low-temperature and heavy unburned three-type-mixed gas and becomes a self-heat-insulated state, so that gas processing with high combustion efficiency is performed without a temperature drop due to heat dissipation.

Normally, the processing gas is diluted with $N_2$ gas or the like and then flown into the exhaust gas processing apparatus. Therefore, by performing mixed combustion of the processing gas containing the $N_2$ gas, the fuel, and the combustion supporting gas, a slow combustion is performed and a locally high temperature portion is not formed, so that generation of $NO_x$ is suppressed.

Further, by performing mixed combustion of the processing gas containing $N_2$ gas, the fuel, and the combustion supporting gas, the diameter of a cylindrical flame is reduced and an inner wall surface temperature of the combustion chamber 1 is lowered. That is, the heat insulating properties of the flame, which are features of the present combustion method, are promoted, so that as shown in FIG. 7, even when the wetted wall (water film) is formed on the inner wall surface of the combustion chamber 1, the combustion gas temperature of the flame and the combustion gas temperature inside the flame are not lowered.

Powder such as $SiO_2$ generated after the combustion is collected by the outer wetted wall water 23*a* by a centrifugal force of a gas swirling flow and is washed away to lower portions, so that the powder is not accumulated on the inner wall surface of the combustion chamber 1 and almost all powder is collected by the wetted wall water 23*a* in the combustion chamber 1. Therefore, scrubber performance (powder removal performance) of the exhaust gas processing apparatus is improved. Corrosive gas is also washed away by the wetted wall water 23*a*, and corrosion of the inner wall surface of the combustion chamber 1 can be prevented.

As described above, the inner wall surface temperature of the combustion chamber 1, that is, the inner wall surface temperature of the chassis 11 of the burner head 100, is low at around 40 degrees. If the inner wall surface temperature of the chassis 11 rises to several hundred degrees, the fastening module 11*b*1 cannot be attached by welding, so that a flange is used. Therefore, the combustion chamber 1 has to be enlarged.

On the other hand, in the present embodiment, the inner wall surface temperature of the chassis 11 is low, so that thermal stress is low. Therefore, the fastening module 11*b*1 can be attached to the chassis 11 (the annular portion 11*b* in the example of FIG. 2) by welding, so that the combustion chamber 1 can be miniaturized. Further, the fuel nozzle 13*a*, the combustion supporting gas nozzle 13*b*, and the processing gas nozzle 13*c* can also be attached to the chassis 11 (the cylindrical portion 11*a* in the example of FIG. 2) by welding.

Next, a processing example of the processing gas (exhaust gas) by the combustion chamber 1 described above will be described. Appropriate flow rates of the fuel and the combustion supporting gas where gas temperature required for gas processing is secured are set while composition of a gas mixture of three types of gases including the processing gas (containing $N_2$ gas as a main component), the fuel gas, and the combustion supporting gas is used as a combustion range according to an inflow rate of the processing gas into the combustion chamber 1. Hereinafter, a relationship between the composition of the gas mixture of three types of gases and the combustion range will be described by using a case where the fuel gas is propane.

When the combustion supporting gas is pure oxygen and the processing gas does not contain $N_2$, the lower limit of combustion of propane component % with respect to the gas mixture is 2%, and the upper limit of that is 40%. When the combustion supporting gas is air (composition ratio between $N_2$ and $O_2$ is 79:21), it is known that the lower limit of combustion of propane component % with respect to the gas mixture is 2%, and the upper limit of that is 10%.

When $N_2$ which is a main component of the processing gas is added to the above and the composition ratio between $N_2$ and $O_2$ becomes, for example, 85:15, it is known that the lower limit of combustion of propane component % with respect to the gas mixture is 2%, and the upper limit of that is 6%. When the fuel gas (fuel) is another gas such as city gas or natural gas, the combustion range of the gas mixture may be obtained by the same method as that when propane is the fuel gas.

That is, adjustment can be performed based on a relationship between the composition and the combustion range of the gas mixture of the fuel gas, the combustion supporting gas (oxygen and air), and $N_2$ of the processing gas. For example, when two sets of the fuel nozzles 13*a*, the combustion supporting gas nozzles 13*b*, and the processing gas nozzles 13*c*, which are installed on the same plane, are installed, it is possible to improve flame stability by changing balance (composition ratio) between the fuel flow rate, the combustion supporting gas flow rate, and the processing gas flow rate, for example, decreasing the processing gas inflow rate on the upper set and increasing the processing gas inflow rate on the lower set.

Next, a manufacturing method of the burner head 100 shown in FIG. 2 will be described. In general, the burner head 100 is manufactured by welding the fastening module 11*b*1, the fuel nozzle 13*a*, the combustion supporting gas nozzle 13*b*, and the processing gas nozzle 13*c* to the chassis in an arbitrary order. Hereinafter, a more specific example will be described.

Figure 9A:
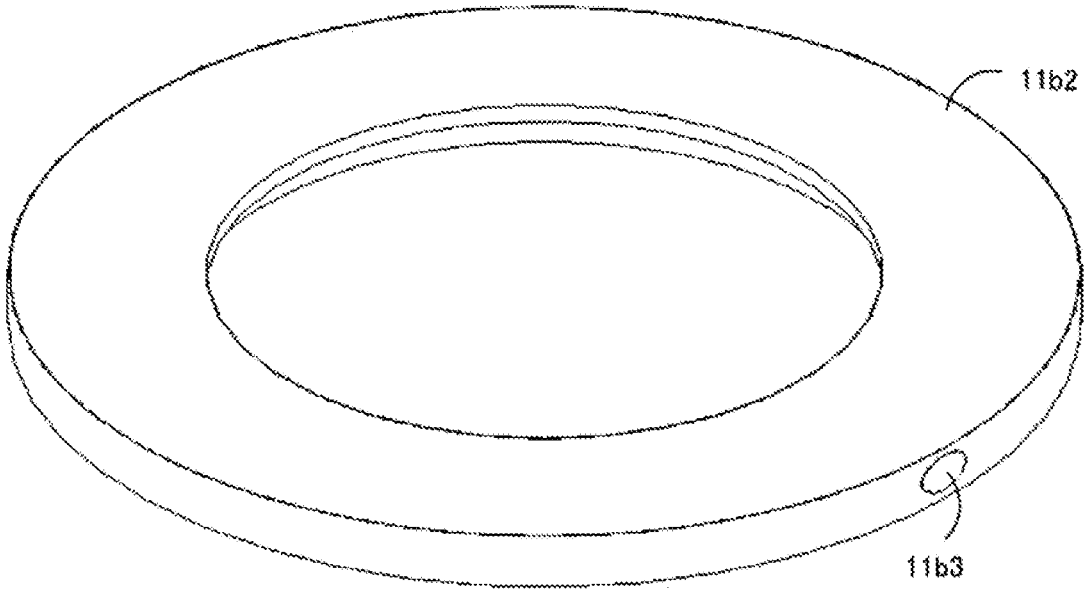
FIG. 9A is a diagram showing an example of a manufacturing procedure of the annular portion 11*b* in a chassis 11.
Figure 9B:
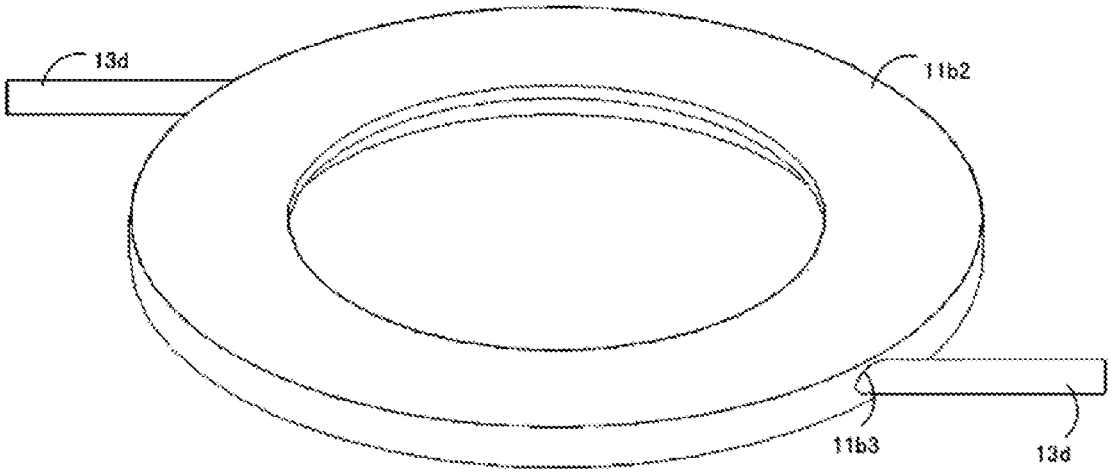
FIG. 9B is a diagram showing an example of the manufacturing procedure of the annular portion 11*b* in the chassis 11.
Figure 9C:
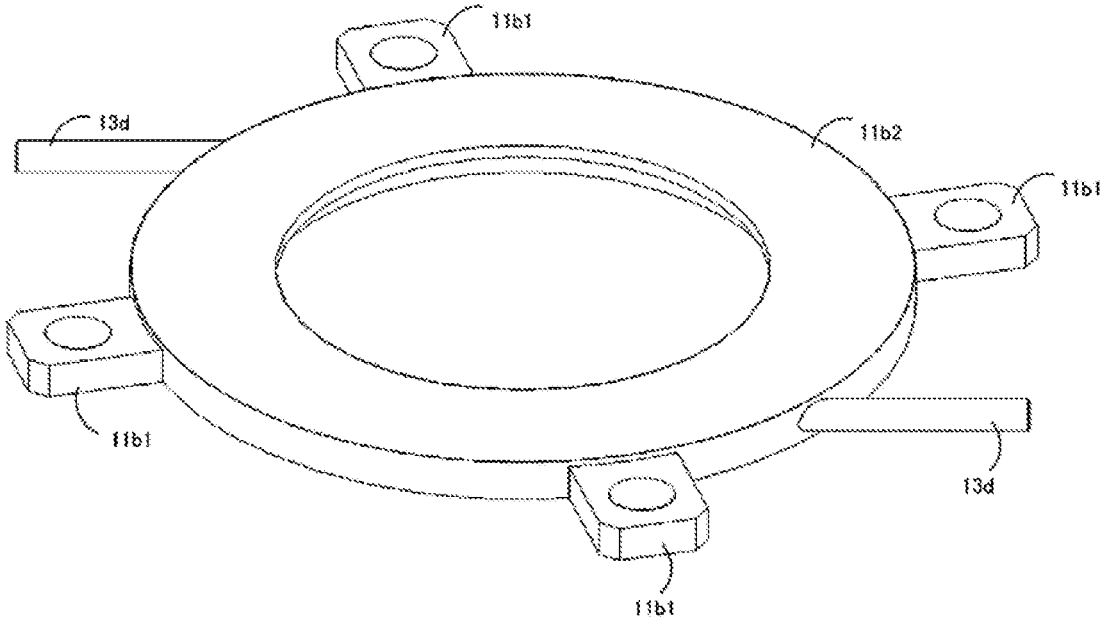
FIG. 9C is a diagram showing an example of the manufacturing procedure of the annular portion 11*b* in the chassis 11.

FIGS. 9A to 9C are diagrams showing an example of a manufacturing procedure of the annular portion 11*b* in the chassis 11. First, as shown in FIG. 9A, the openings 11*b*3 and the circular groove 11*b*4 (not shown in FIG. 9A) are formed in a side surface of a stainless-steel ring-shaped member 11*b*2. Subsequently, as shown in FIG. 9B, the purge gas nozzles 13*d* are welded to the positions of the openings 11*b*3. Next, as shown in FIG. 9C, four fastening modules 11*b*1 are welded to the side surface of the ring-shaped member 11*b*2 at positions different from the openings 11*b*3. Thereby, the annular portion 11*b* is completed.

Figure 10A:
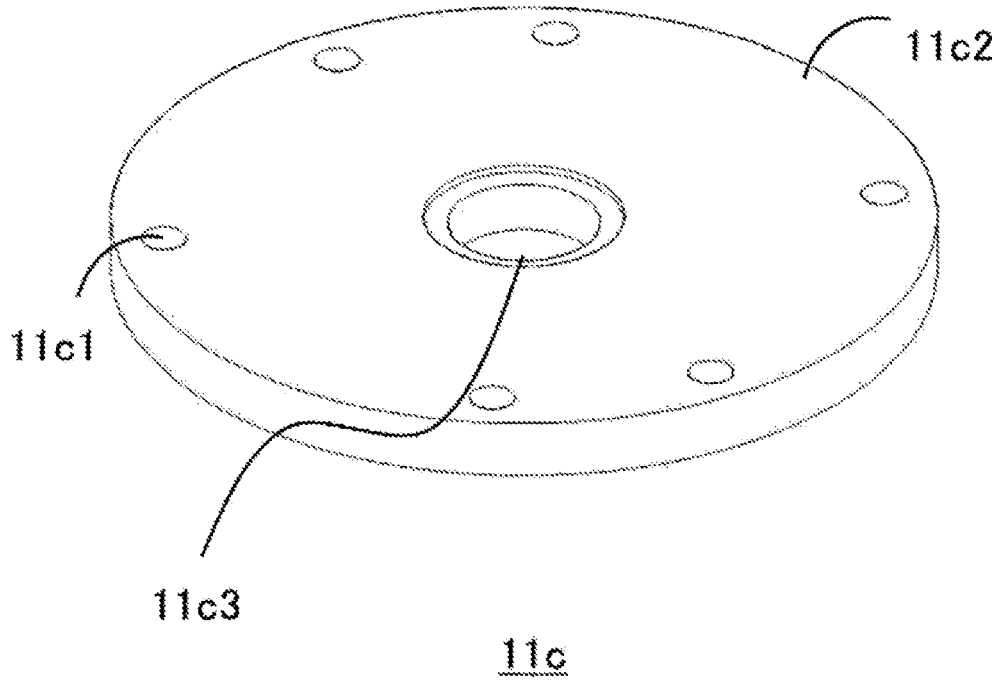
FIG. 10A is a diagram showing an example of a manufacturing procedure of the ceiling module 11*c* and the projecting module 11*d* in the chassis 11.
Figure 10B:
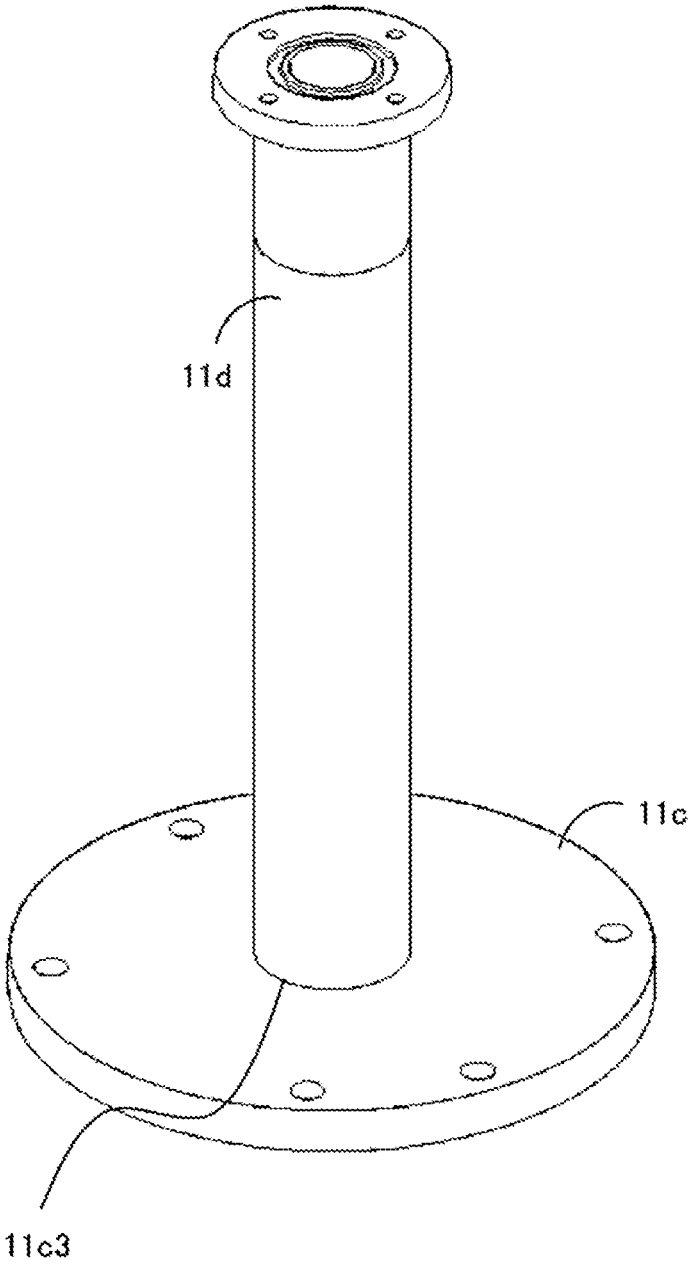
FIG. 10B is a diagram showing an example of the manufacturing procedure of the ceiling module 11*c* and the projecting module 11*d* in the chassis 11.
Figure 10C:
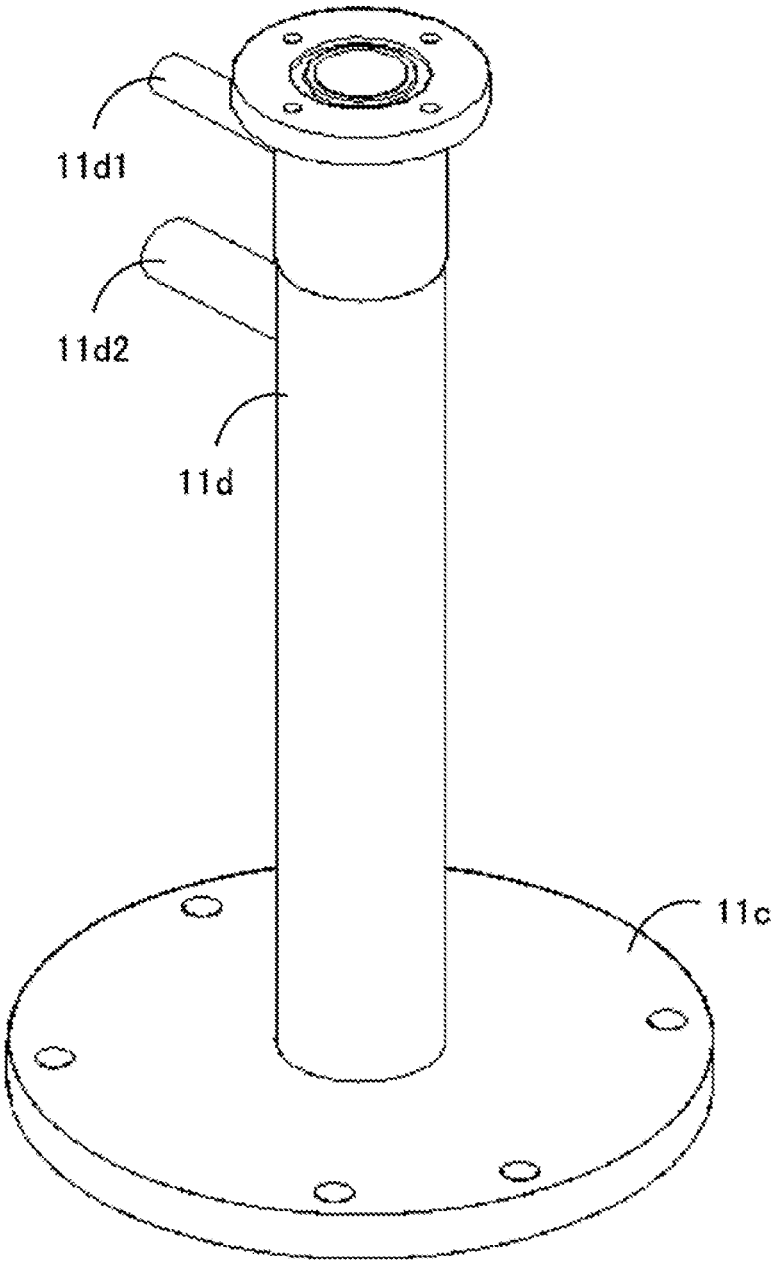
FIG. 10C is a diagram showing an example of the manufacturing procedure of the ceiling module 11*c* and the projecting module 11*d* in the chassis 11.

FIGS. 10A to 10C are diagrams showing an example of a manufacturing procedure of the ceiling module 11*c* and the projecting module 11*d* in the chassis 11. As shown in FIG. 10A, the ceiling module 11*c* is manufactured by forming holes 11*c*1 in an outer peripheral portion of a stainless-steel circular member 11*c*2 and an opening 11*c*3 in the central portion of the circular member 11*c*2. Subsequently, as shown in FIG. 10B, the projecting module 11*d* is attached to a position of the opening 11*c*3. Next, as shown in FIG. 10C, the fuel supply nozzle 11*d*1 is welded to an upper portion of the projecting module 11*d*, and the air supply nozzle 11*d*2 is welded to a portion below the fuel supply nozzle 11*d*1. Thereby, the ceiling module 11*c* and the projecting module 11*d* are completed.

Figure 11A:
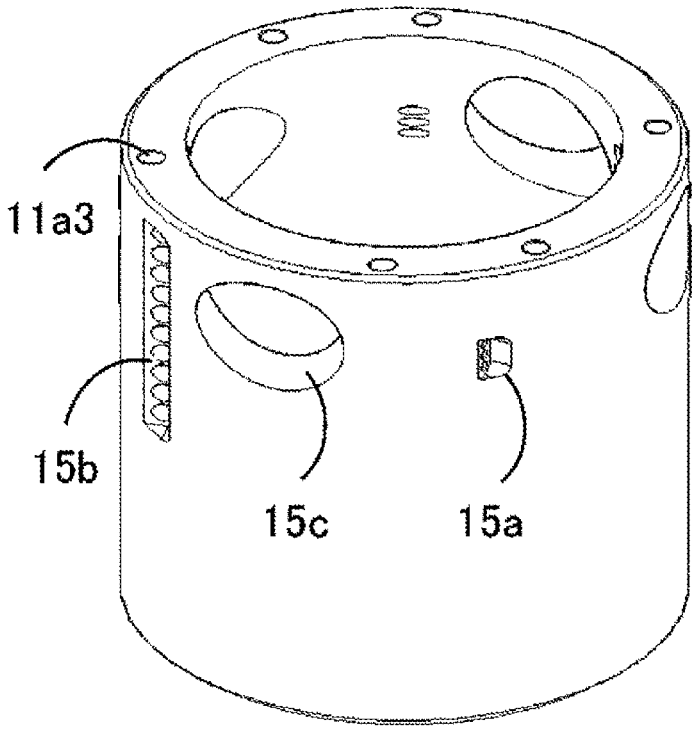
FIG. 11A is a diagram showing an example of a manufacturing procedure of the burner head 100.
Figure 11B:
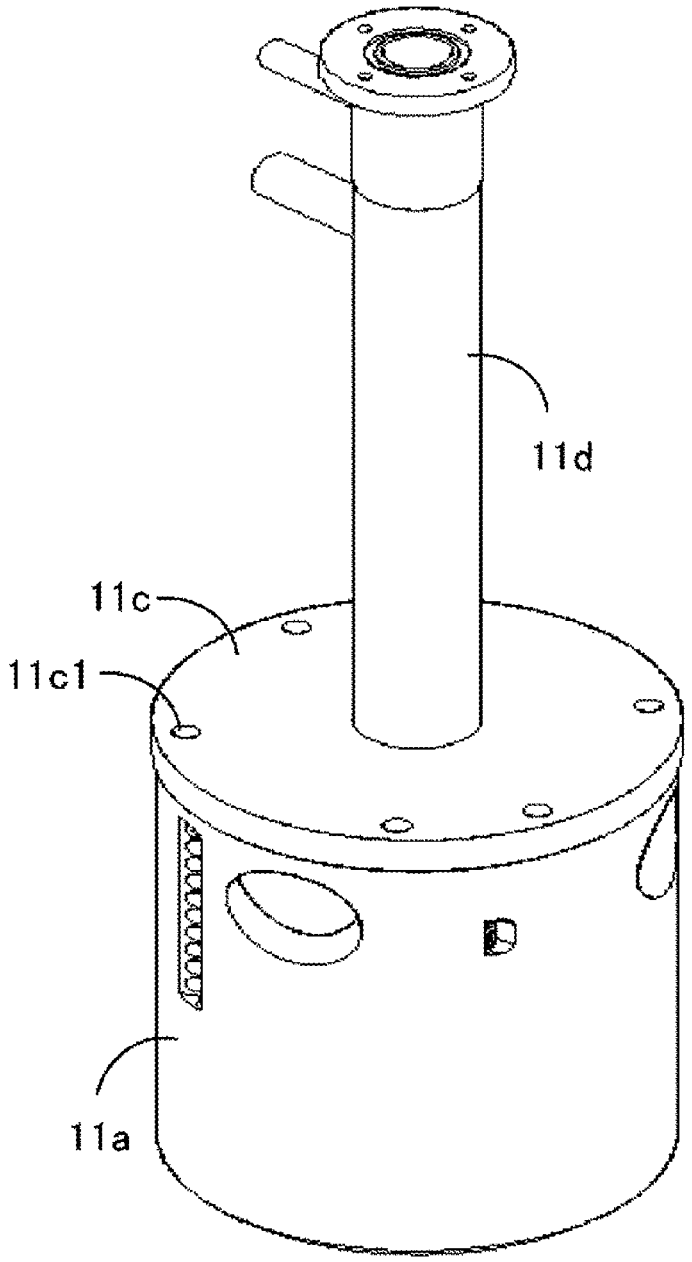
FIG. 11B is a diagram showing the example of the manufacturing procedure of the burner head 100.

FIGS. 11A to 11F are diagrams showing an example of a manufacturing procedure of the burner head 100. First, as shown in FIG. 11A, the openings 15*a* to 15*c* are formed in a side surface of a thick stainless-steel pipe with a thickness of about 10 mm and an inner diameter of about 70 mm, and the holes 11*a*3 are formed in an upper surface of the thick stainless-steel pipe. Thereby, the cylindrical portion 11*a* is manufactured. Subsequently, as shown in FIG. 11B, the ceiling module 11*c* is attached to an upper portion of the cylindrical portion 11*a*. At this time, the holes 11*a*3 of the cylindrical portion 11*a* and the holes 11*c*1 of the ceiling module 11*c* are caused to match each other in the vertical direction.

Figure 11C:
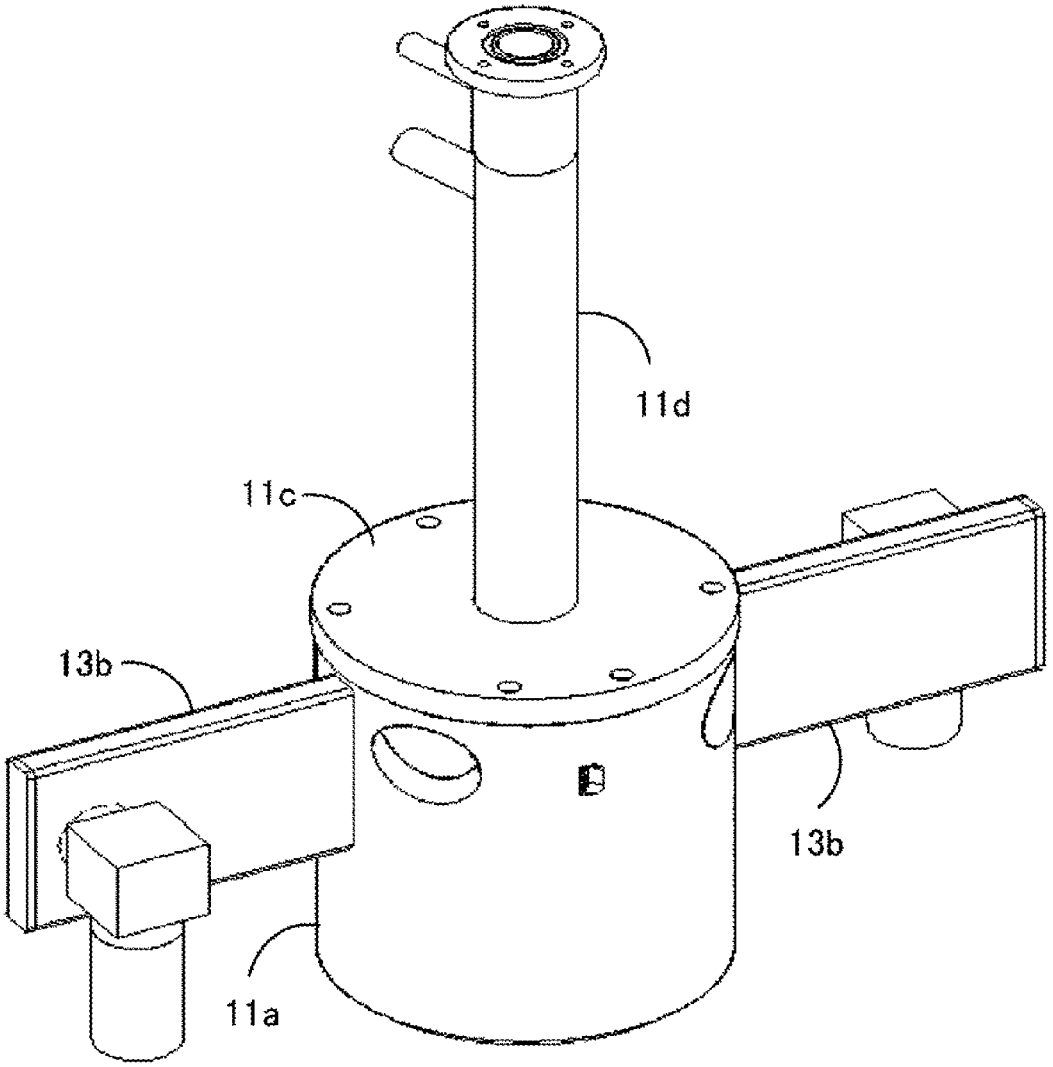
FIG. 11C is a diagram showing the example of the manufacturing procedure of the burner head 100.
Figure 11D:
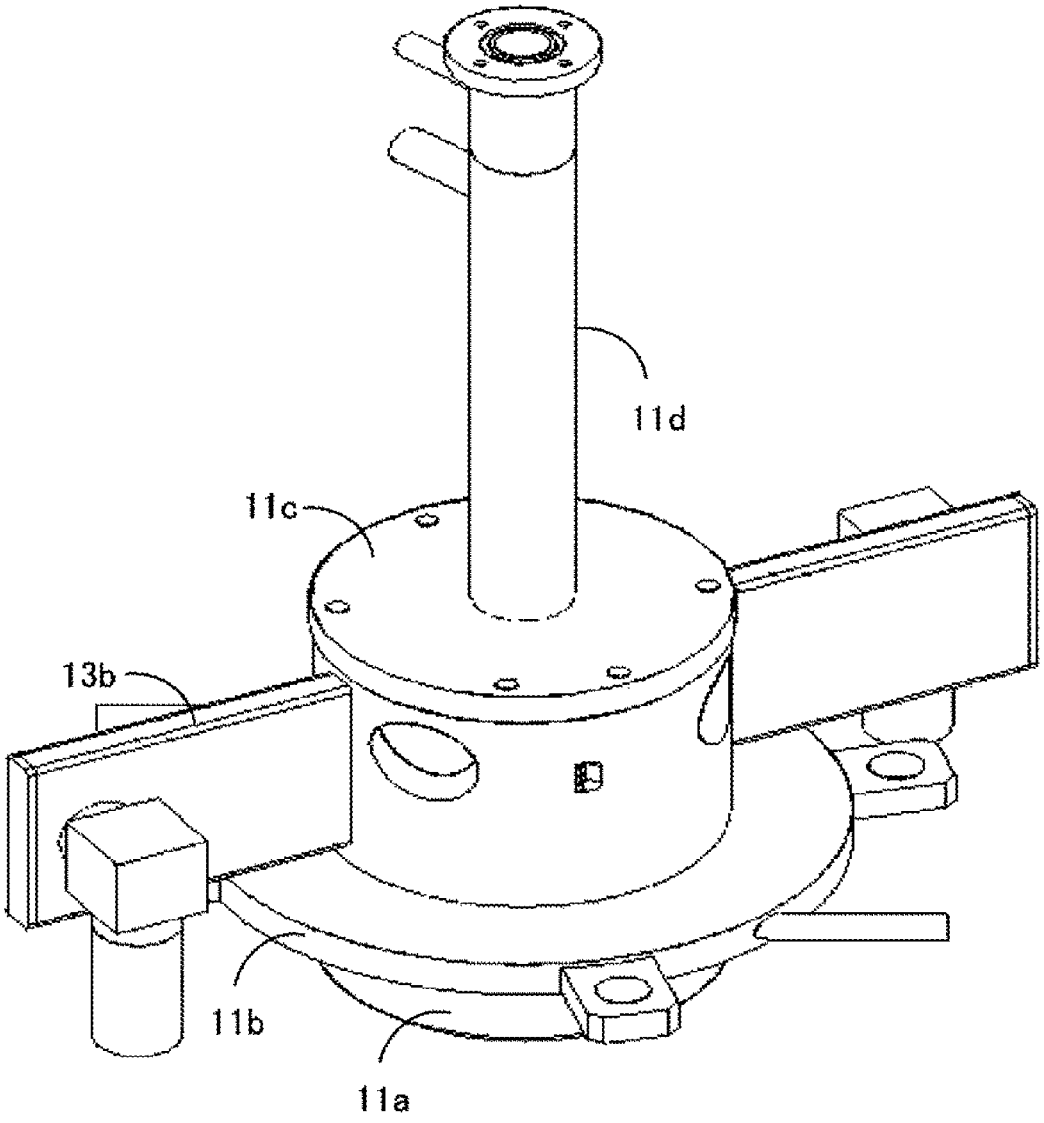
FIG. 11D is a diagram showing the example of the manufacturing procedure of the burner head 100.
Figure 11E:
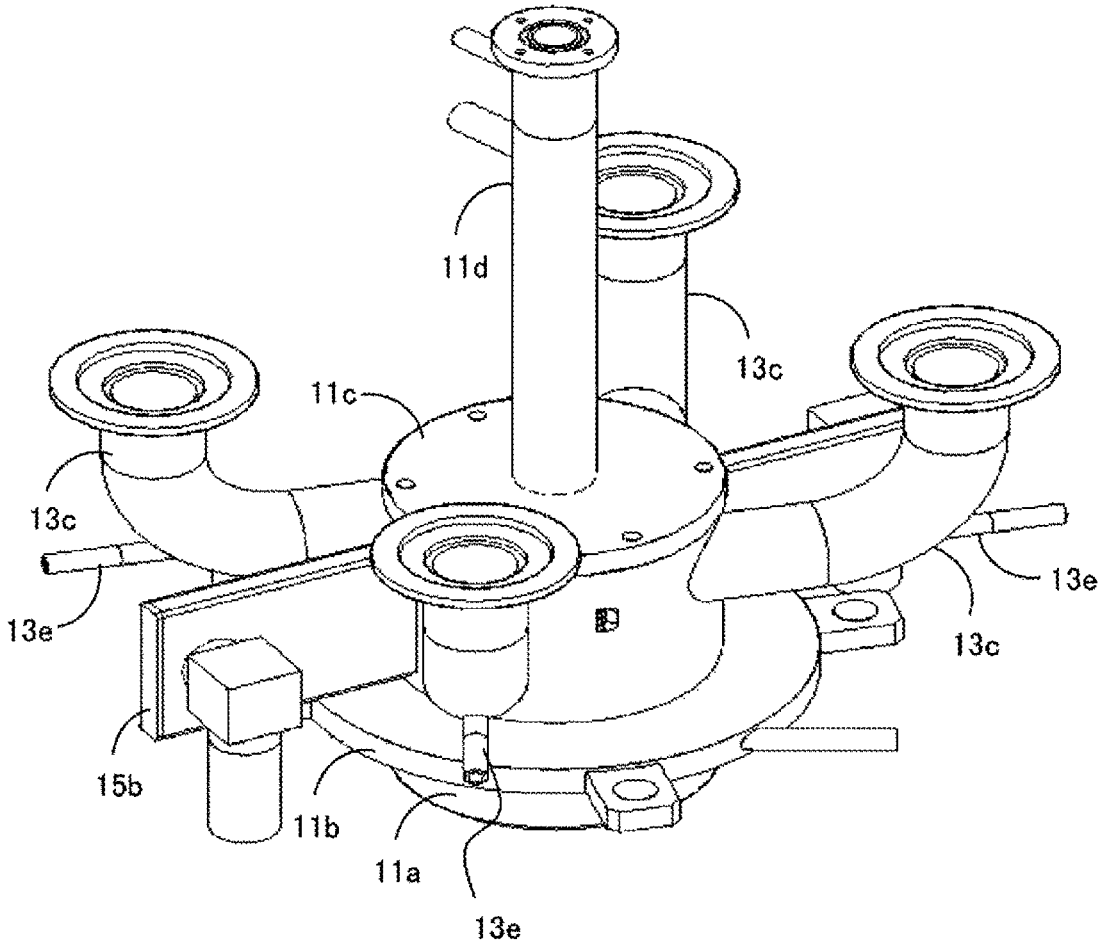
FIG. 11E is a diagram showing the example of the manufacturing procedure of the burner head 100.
Figure 11F:
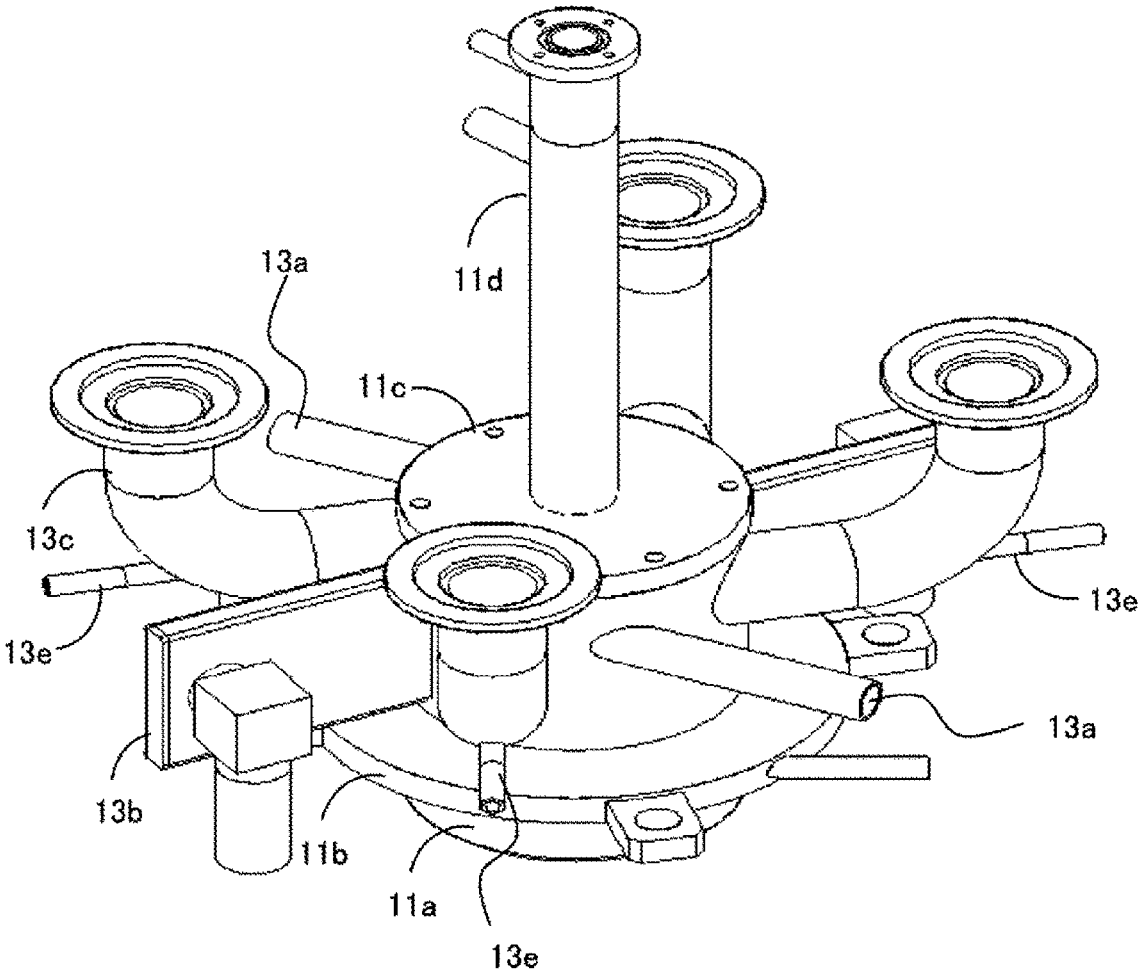
FIG. 11F is a diagram showing the example of the manufacturing procedure of the burner head 100.

Next, as shown in FIG. 11C, two combustion supporting gas nozzles 13*b* manufactured in advance are welded to positions of the openings 15*b* of the cylindrical portion 11*a*. Thereafter, as shown in FIG. 11D, the annular portion 11*b* is fitted and fixed to the cylindrical portion 11*a* from below the cylindrical portion 11*a*. Next, as shown in FIG. 11E, four processing gas nozzles 13*c* manufactured in advance are welded to positions of the openings 15*c* of the cylindrical portion 11*a*. Further, as shown in FIG. 11F, two fuel nozzles 13*a* are welded to positions of the openings 15*a* of the cylindrical portion 11*a*. In this way, the burner head 100 is completed.

Regarding the burner head 100 described above, a case is described where two fuel nozzles 13*a*, two combustion supporting gas nozzles 13*b*, and four processing gas nozzles 13*c* are located on the same plane perpendicular to the axis line of the cylindrical combustion chamber 1. However, even when these nozzles are arranged shifted in the axial direction of the combustion chamber 1, the three-type-mixed cylindrical mixed flame, which floats from the inner wall of the combustion chamber 1, can be formed if the following conditions (1) and (2) are satisfied. Further, the fuel nozzle 13*a*, the combustion supporting gas nozzle 13*b*, and the processing gas nozzle 13*c* may be divided into a plurality of nozzles and arranged at intervals in the circumferential direction of the combustion chamber 1.

(1) The fuel nozzle 13*a*, the combustion supporting gas nozzle 13*b*, and the processing gas nozzle 13*c* blows the fuel (fuel gas), the combustion supporting gas, and the processing gas, respectively, in the tangential direction of the inner circumferential surface of the combustion chamber 1 and forms a swirling flow of three-type mixture of the fuel, the combustion supporting gas, and the processing gas.

(2) When at least one gas blown into the combustion chamber 1 among the fuel (fuel gas), the combustion supporting gas, and the processing gas is finally blown into the combustion chamber 1 and a three-type mixed swirling flow is formed, the composition of the gas mixture of the three types of gases reaches the combustion range.

The three-type-mixed cylindrical mixed flame, which floats from the inner wall of the combustion chamber 1, can be formed if the following conditions (1) and (2) are satisfied. After the three-type-mixed cylindrical mixed flame is formed, by further providing the fuel nozzle 13*a* and the processing gas nozzle 13*c* on the downstream side (post-stage) of the fuel nozzle 13*a*, the combustion supporting gas nozzle 13*b*, and the processing gas nozzle 13*c*, and blowing the fuel and the processing gas from these nozzles, it is possible to improve combustion temperature and improve gas processing performance.

Next, various modified examples that satisfy the conditions (1) and (2) described above will be described with reference to the drawings.

First, which nozzle is selected from among the fuel nozzle 13*a*, the combustion supporting gas nozzle 13*b*, and the processing gas nozzle 13*c* as a nozzle which blows gas into the combustion chamber 1 first and forms a swirling flow first, that is, a nozzle that starts the swirling flow, will be described, and then how to arrange the other nozzles in the downstream side of the swirling flow with reference to the selected nozzle will be described.

While FIGS. 11A to 11F shows examples of manufacturing the burner head 100 by welding, the burner head 100 can also be manufactured by molding.

Figure 12A:
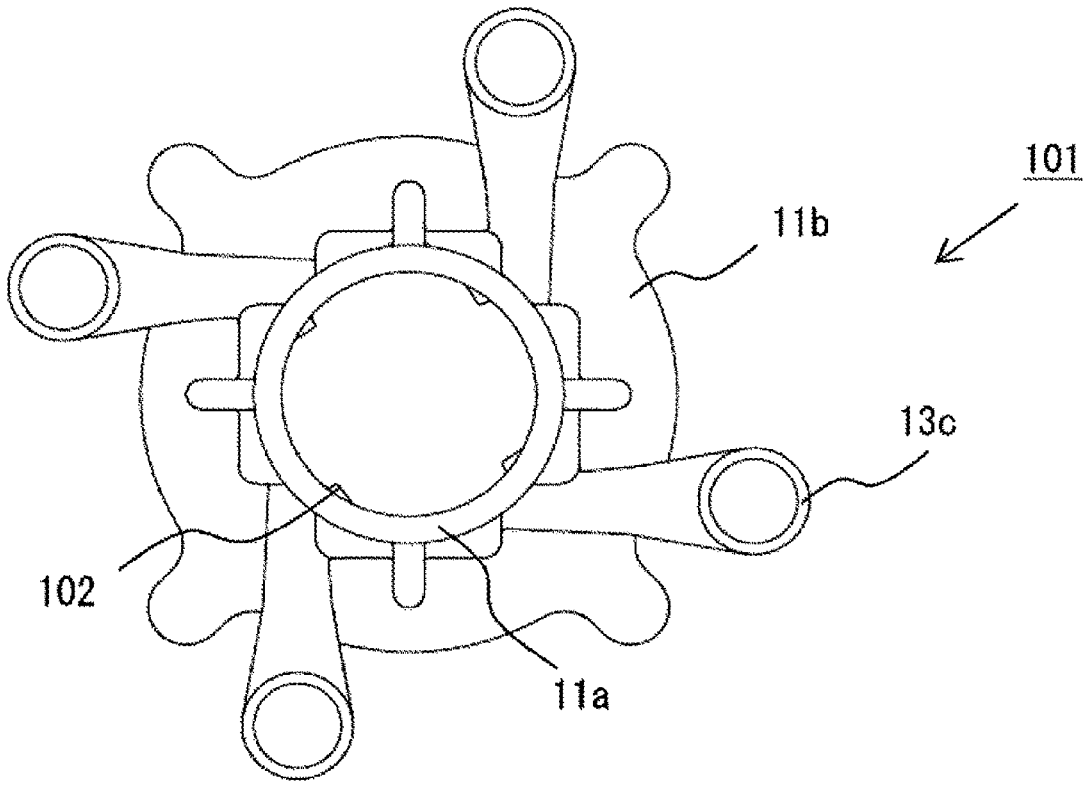
FIG. 12A is a diagram showing another example of the manufacturing procedure of the burner head 100.
Figure 12B:
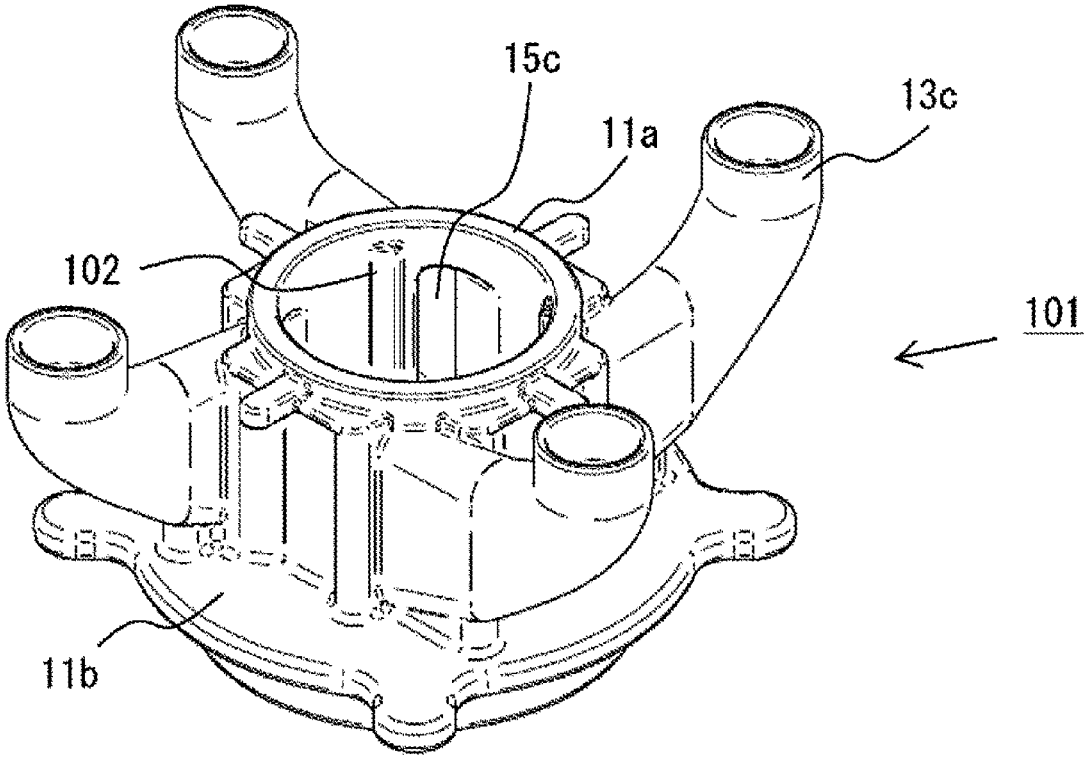
FIG. 12B is a diagram showing the other example of the manufacturing procedure of the burner head 100.
Figure 12C:
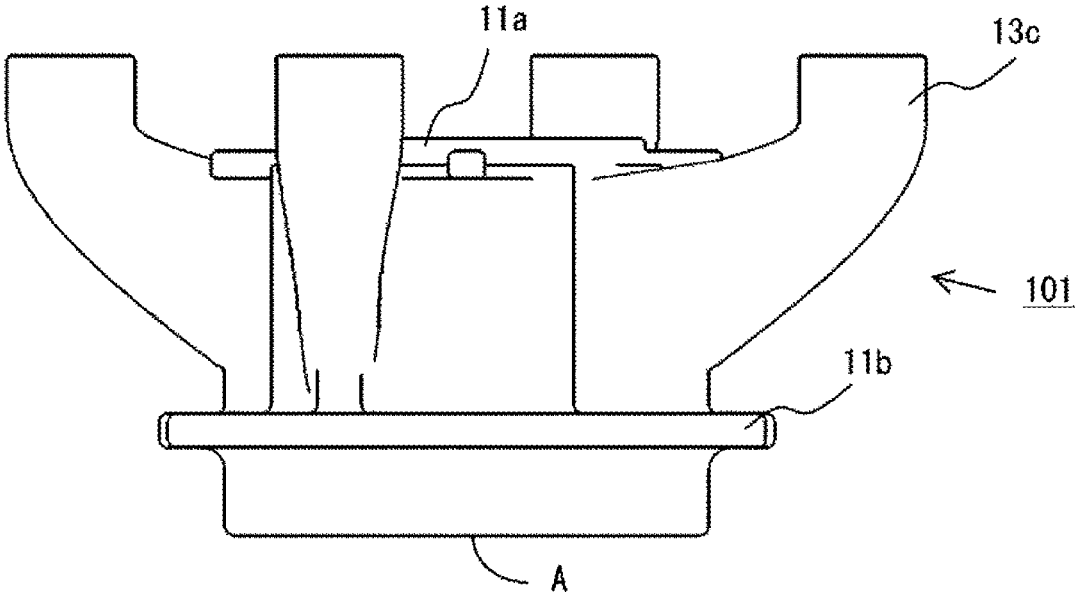
FIG. 12C is a diagram showing the other example of the manufacturing procedure of the burner head 100.

First, a base 101 shown in FIGS. 12A to 12C is made by casting, and cutting and blast finishing of a sprue A on the lower surface are performed. FIGS. 12A to 12C are a top view, a perspective view, and a side view, respectively, of the base 101. The base 101 corresponds mainly to the cylindrical portion 11*a*, the annular portion 11*b*, and the processing gas nozzle 13*c* of the burner head 100.

Here, the opening 15*c* to which the processing gas nozzle 13*c* is connected is formed in the cylindrical portion 11*a* (FIG. 12B). It is desirable that the opening 15*c* has a slit-like shape extending in a longitudinal direction (vertical direction) of the cylindrical portion 11*a*. Thereby, the processing gas flows along the inner surface of the cylindrical portion 11*a*, so that an oxidation air amount is appropriate. As a result, the flame hardly goes out. Stagnation near a burner top plate (the ceiling module 11*c* in FIG. 2) decreases, so that adhesion of product materials is suppressed. Further, water splashes from a gas-liquid interface are reduced, and adhesion of product materials is suppressed. According to the molding, the shape of the opening 15*c* can be relatively freely designed.

As shown in FIG. 12A, it is desirable that a projection 102 is formed inside the cylindrical portion 11*a*. The reason of this will be described later.

Various manufacturing method of the base 101 can be considered. As an example, the base 101 can be manufactured by direct casting using a 3D printer. Specifically, a mold made of resin having the same shape as the base 101 to be a target is formed by using the 3D printer. When spraying ceramic to the mold and burning the ceramic and the mold, the resin is melted and a ceramic mold with a hollow inside is made. When flowing metal into the mold, fixing the metal, and breaking the ceramic mold, the base 101 made of metal is made. According to this method, the base 101 can be inexpensively manufactured in a short time.

In addition, the base 101 made of metal may be made by using a 3D printer, or may be made by using a normal mold.

Figure 13A:
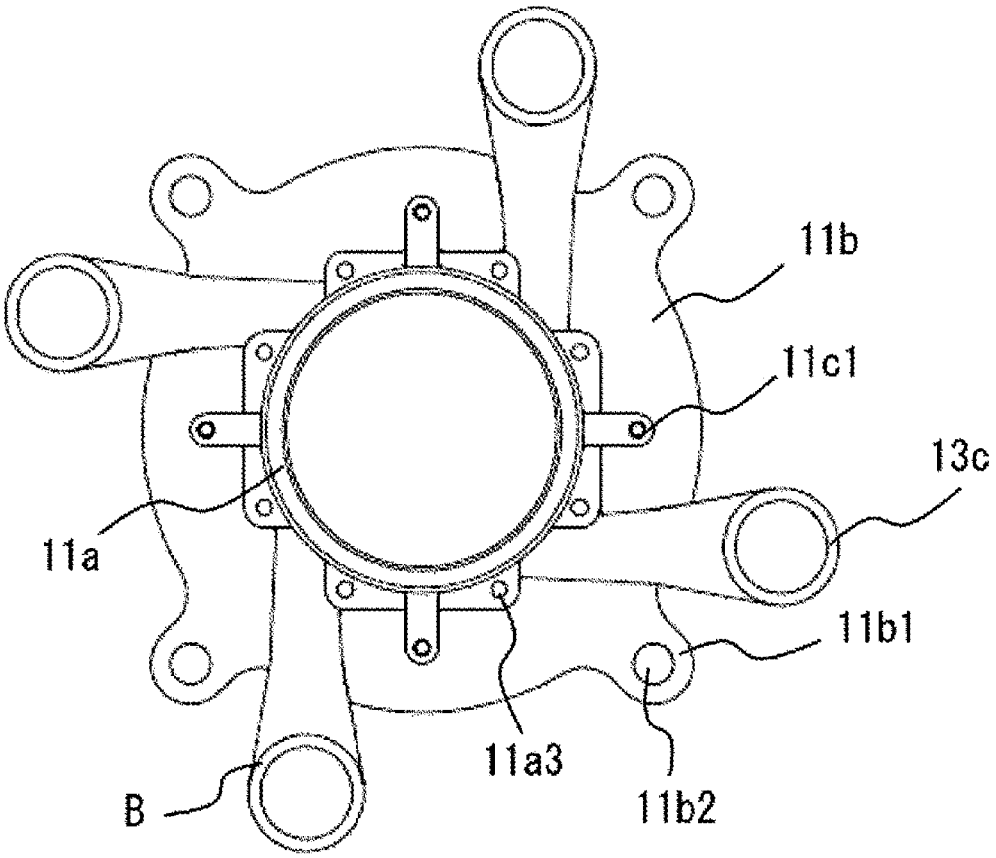
FIG. 13A is a diagram showing the other example of the manufacturing procedure of the burner head 100.

Subsequently, the next machining is performed on the base 101 to achieve a state of FIGS. 13A to 13C.

Figure 13B:
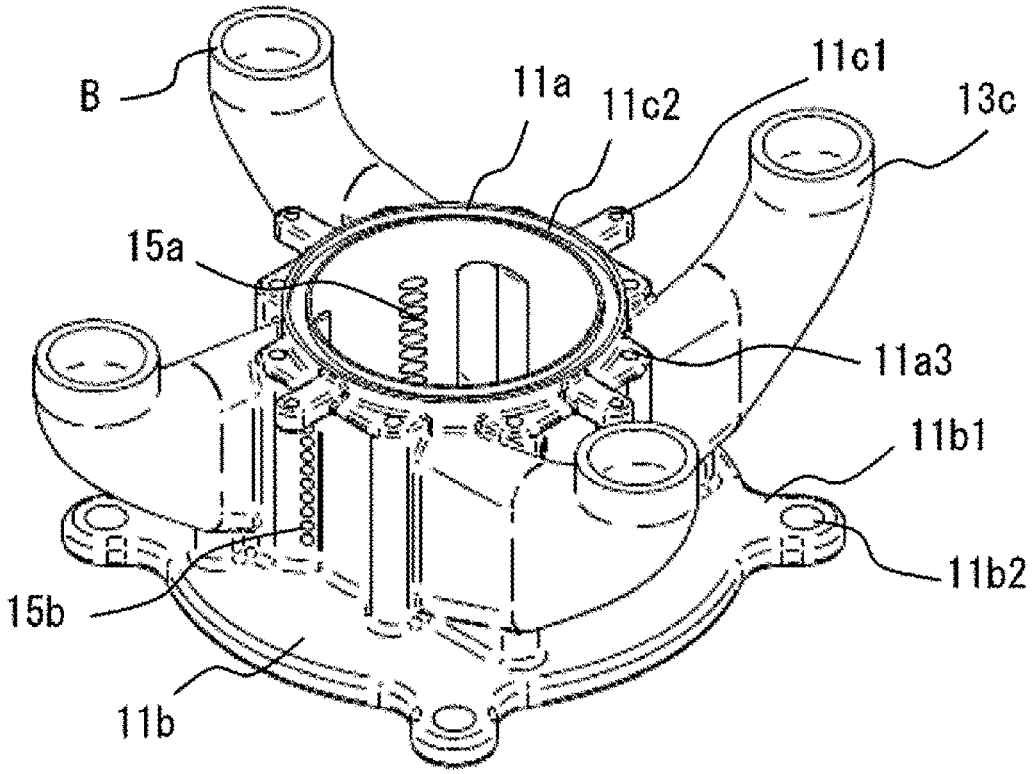
FIG. 13B is a diagram showing the other example of the manufacturing procedure of the burner head 100.
Figure 13C:
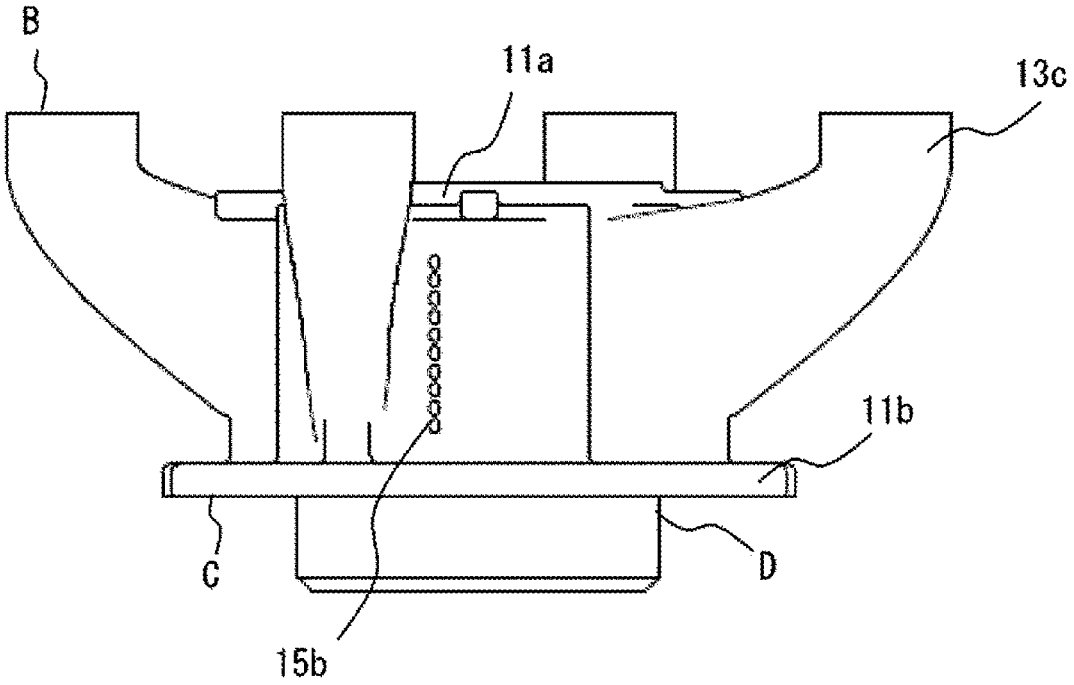
FIG. 13C is a diagram showing the other example of the manufacturing procedure of the burner head 100.

Specifically, the opening 15*a* to which the fuel nozzle 13*a* is connected and the opening 15*b* to which the combustion supporting gas nozzle 13*b* is connected are formed in the cylindrical portion 11*a* by drill processing (FIG. 13B). In this case, there are the projections 102 inside the cylindrical portion 11*a*, so that a vertical surface is secured at a destination of a drill when the drill penetrates from the outer surface of the cylindrical portion 11*a* to the inside projection 102. Therefore, the openings 15*a* and 15*b* can be easily formed. After forming the openings 15*a* and 15*b*, the projections 102 are cut off to make inside a true circle by finish cutting of the inside of the cylindrical portion 11*a*.

Further, the opening 11*b*2 for fastening the annular portion 11*b* to the combustion chamber main body 200 with a bolt is formed in the fastening module 11*b*1 of the annular portion 11*b*. A tap hole 11*c*1 and an O-ring groove 11*c*2 for attaching the ceiling module 11*c* are formed in the upper surface of the cylindrical portion 11*a*. The hole 11*a*3 for inserting the cartridge heater is formed in the upper surface of the cylindrical portion 11*a*.

Further, finish cutting is performed on a flange mounting module B for the processing gas nozzle 13*c*, a fastening module C for fastening to the combustion chamber main body 200, and a suspended module D that doubles as the sprue.

Figure 14A:
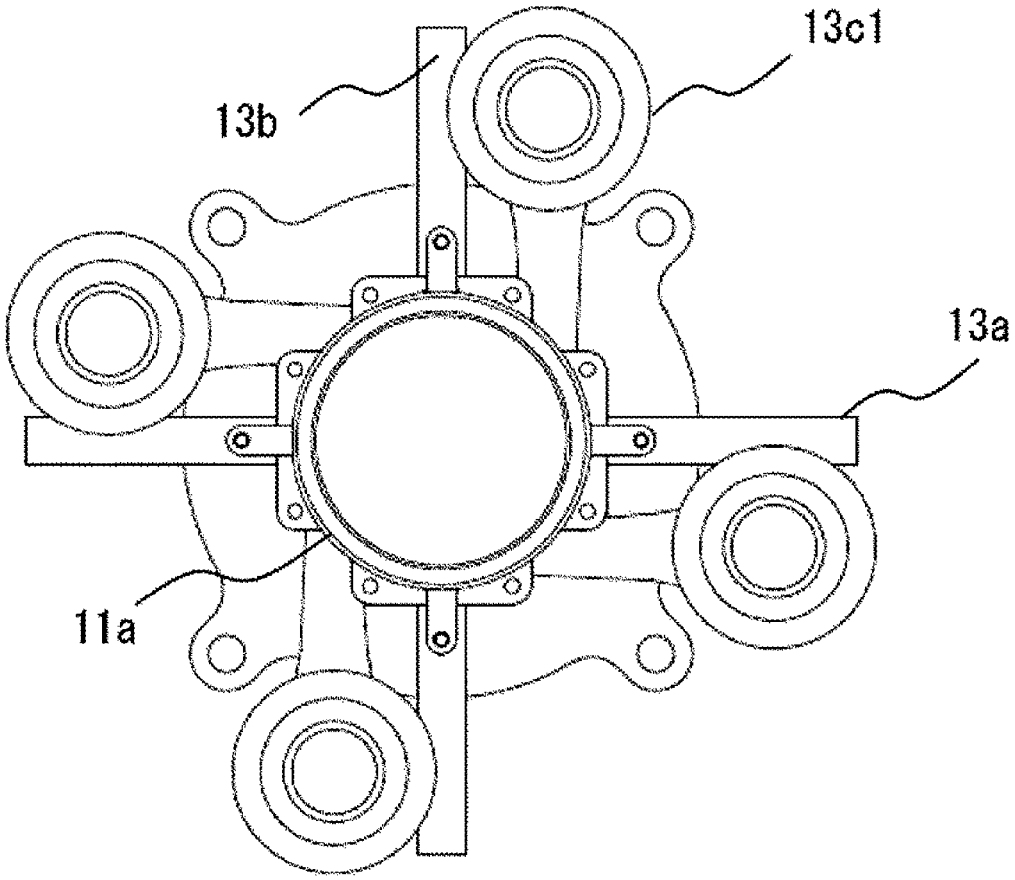
FIG. 14A is a diagram showing the other example of the manufacturing procedure of the burner head 100.
Figure 14B:
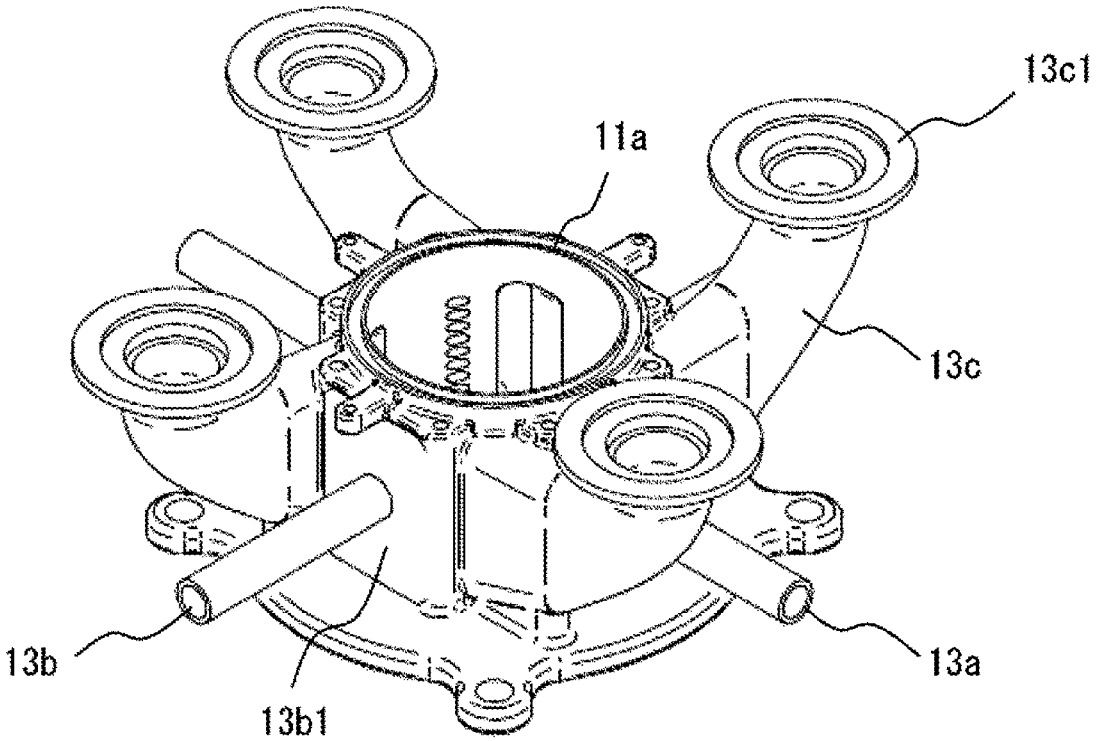
FIG. 14B is a diagram showing the other example of the manufacturing procedure of the burner head 100.
Figure 14C:
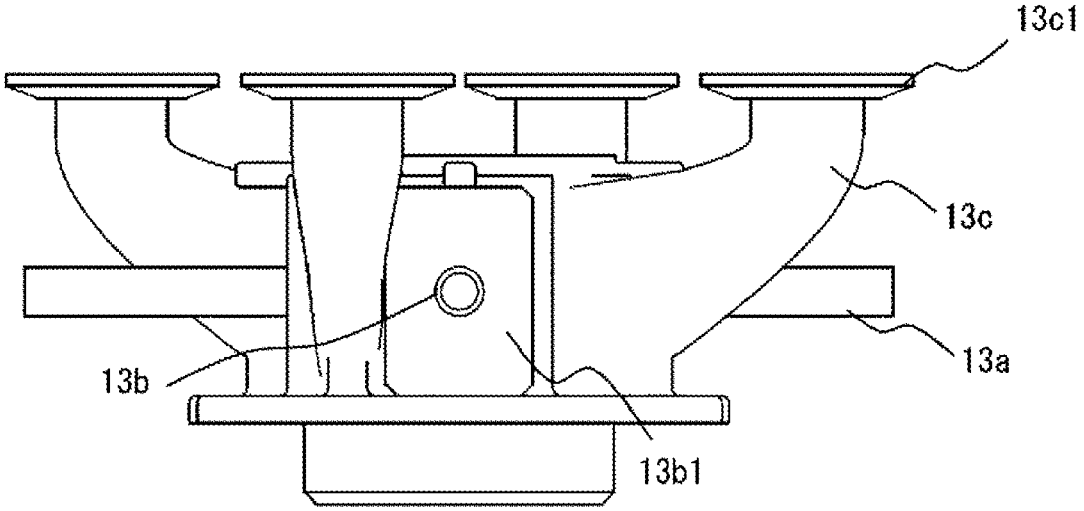
FIG. 14C is a diagram showing the other example of the manufacturing procedure of the burner head 100.

Thereafter, a flange 13*c*1 is welded to the processing gas nozzle 13*c*, the fuel nozzle 13*a* is welded to the opening 15*a* formed in the cylindrical portion 11*a*, and the combustion supporting gas nozzle 13*b* is welded to the opening 15*b* formed in the cylindrical portion 11*a*, achieve a state of FIGS. 14A to 14C. When the combustion supporting gas nozzle 13*b* is attached to the cylindrical portion 11*a* through a lid module 13*b*1, a vacant room is formed between the lid module 13*b*1 and the outer surface of the cylindrical portion 11*a*. Thereby, the fuel supplied from the combustion supporting gas nozzle 13*b* evenly reaches the openings 15*b* from the uppermost opening 15*b* to the lowermost opening 15*b*, so that the combustion supporting gas is uniformly supplied into the cylindrical portion 11*a*. The same goes for the fuel nozzle 13*a*.

Thereafter, the ceiling module 11*c*, the projecting module 11*d*, and the pilot burner 12 are attached onto the cylindrical portion 11*a*, so that the burner head 100 is completed.

Figure 15A:
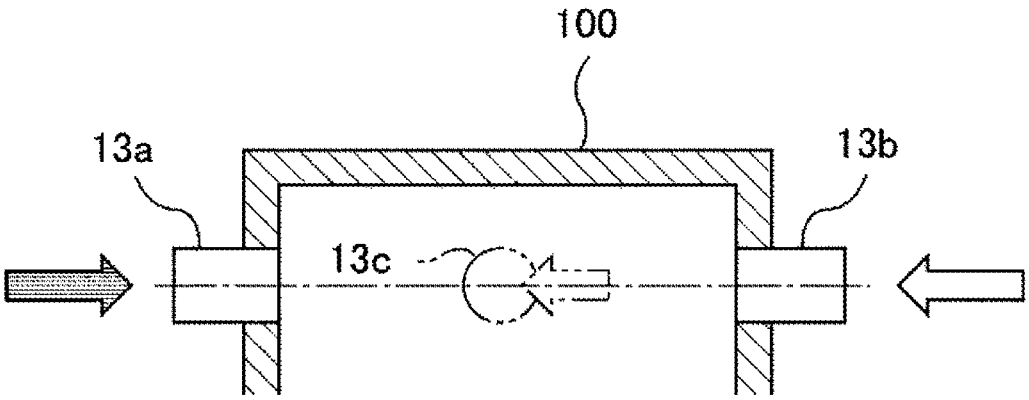
FIG. 15A is a partial vertical surface view of the combustion chamber 1.
Figure 15B:
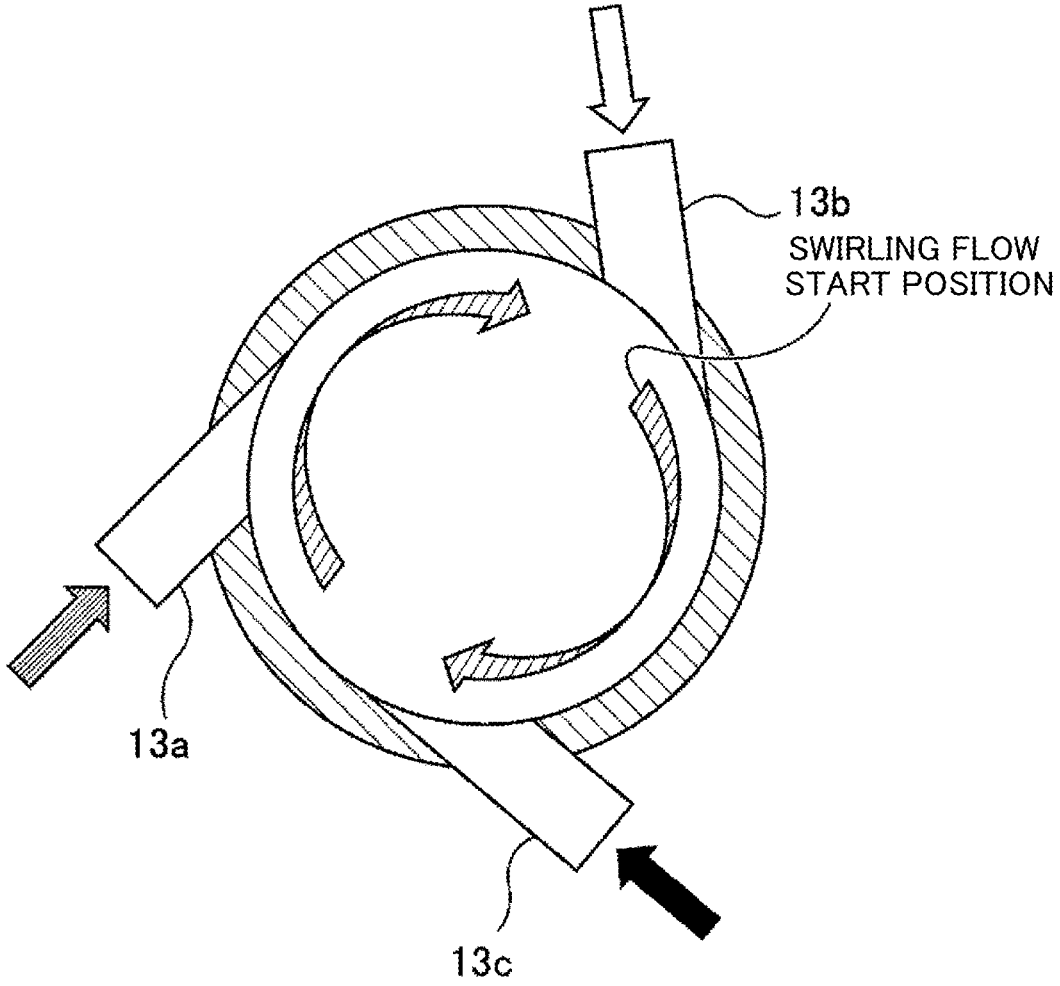
FIG. 15B is a horizontal cross-sectional view of the combustion chamber 1.

FIGS. 15A and 15B are schematic diagrams showing a case where one set (or the upper set of two sets) of the fuel nozzles 13*a*, the combustion supporting gas nozzles 13*b*, and the processing gas nozzles 13*c* is shown and the number of processing gas blowing nozzles is small (one). FIG. 15A is a partial vertical surface view of the combustion chamber 1. FIG. 15B is a horizontal cross-sectional view of the combustion chamber 1.

When the combustion supporting gas is air and the air ratio is 1.3, air of about fifteen times the fuel flow rate is required. In this case, the flow rate and the flow velocity of the air dominate a swirling force in the combustion chamber 1. Therefore, as shown in FIGS. 15A and 15B, the combustion supporting gas nozzle 13*b* that blows air as the combustion supporting gas is selected as a nozzle that starts the swirling flow. Thereby, the ceiling module 11*c* of the burner head 100 in the combustion chamber 1 is cooled by the combustion supporting gas immediately before the flame is formed, so that it is possible to reduce the loss of heat quantity due to heat dissipation from the ceiling module 11*c*, and it contributes energy saving.

The processing gas nozzle 13*c* and the fuel nozzle 13*a* are arranged in this order toward the downstream side of the swirling flow with reference to the selected combustion supporting gas nozzle 13*b*. Specifically, the processing gas nozzle 13*c* that blows processing gas composed mainly of diluent $N_2$ is installed between the combustion supporting gas nozzle 13*b* and the fuel nozzle 13*a*, so that the combustion supporting gas is mixed with the processing gas (composed mainly of $N_2$) and thereafter the combustion supporting gas is further mixed with the fuel gas and ignited. Therefore, no local high-temperature portion is formed and a flame having a uniform temperature field is formed. Thereby, it is possible to suppress generation of thermal $NO_x$ while improving the gas processing performance.

FIGS. 15A and 155 illustrate a configuration where the fuel nozzle 13*a*, the combustion supporting gas nozzle 13*b*, and the processing gas nozzle 13*c* are located on the same plane perpendicular to the axis line of the cylindrical combustion chamber 1. However, when these nozzles are arranged shifted in the axial direction of the combustion chamber 1, in FIG. 5A, the combustion supporting gas nozzle 13*b* is arranged in the uppermost position, and the processing gas nozzle 13*c* and the fuel nozzle 13*a* may be arranged shifted downward in this order. In the cross-sectional view shown in FIG. 15A, the processing gas nozzle 13*c* located on the near side (front side) of the cross-section is indicated by a virtual line. The same goes for the drawings described below.

Figure 16A:
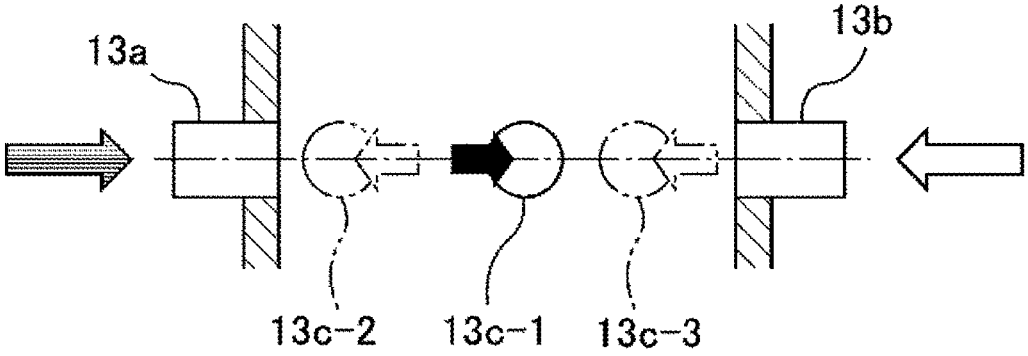
FIG. 16A is a partial vertical surface view of the combustion chamber 1.
Figure 16B:
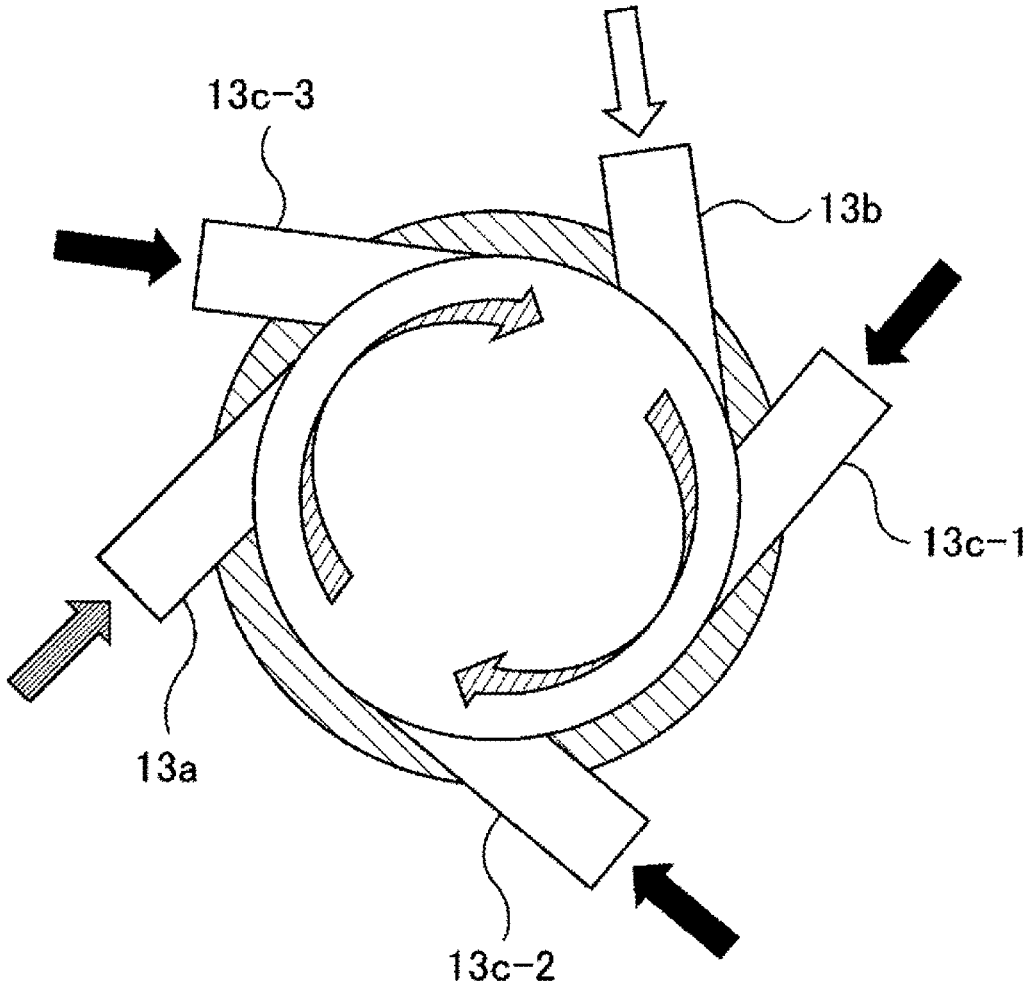
FIG. 16B is a horizontal cross-sectional view of the combustion chamber 1.

FIGS. 16A and 16B are schematic diagrams showing an example of a lower set in a case where the processing gas nozzles 13*c* cannot be included in one set and an upper set and a lower set of the fuel nozzle 13*a*, the combustion supporting gas nozzle 13*b*, and the processing gas nozzles 13*c* are installed. FIG. 16A is a partial vertical cross-sectional view of the combustion chamber 1. FIG. 16B is a horizontal cross-sectional view of the combustion chamber 1.

As shown in FIGS. 16A and 16B, in the lower set, the combustion supporting gas nozzle 13*b* is arranged in the most upstream side of the swirling flow, and a processing gas nozzle 13*c*-1, a processing gas nozzle 13*c*-2, the fuel nozzle 13*a*, and a processing gas nozzle 13*c*-3 are arranged in this order toward the downstream side of the swirling flow with reference to the combustion supporting gas nozzle 13*b* arranged in the most upstream side.

In this way, the fuel nozzle 13*a*, the combustion supporting gas nozzle 13*b*, and the processing gas nozzles 13*c*-1, 13*c*-2, and 13*c*-3 are also provided in the lower set, so that a gas mixing rate is equalized. Therefore, it is possible to form a flame having a uniform temperature field without forming a local high-temperature portion. Thereby, it is possible to suppress generation of thermal $NO_x$ while improving the gas processing performance.

Figure 17A:
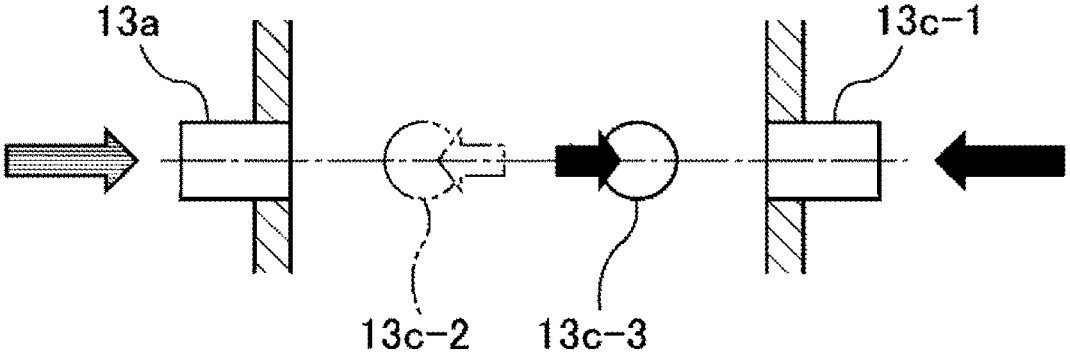
FIG. 17A is a partial vertical surface view of the combustion chamber 1.
Figure 17B:
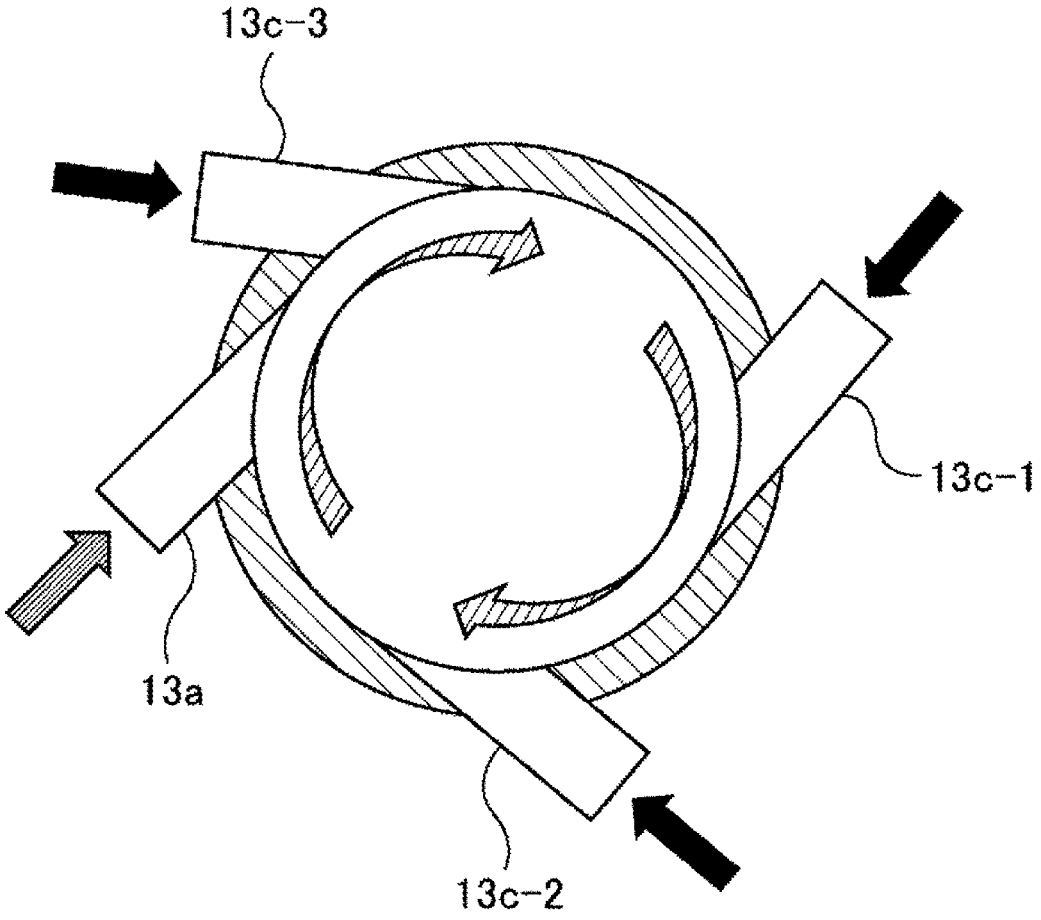
FIG. 17B is a horizontal cross-sectional view of the combustion chamber 1.

FIGS. 17A and 17B are schematic diagrams showing another example of the lower set in a case where the processing gas nozzles 13*c* cannot be included in one set and the upper set and the lower set are installed. FIG. 17A is a partial vertical cross-sectional view of the combustion chamber 1. FIG. 17B is a horizontal cross-sectional view of the combustion chamber 1.

As shown in FIGS. 17A and 17B, in the lower set, the processing gas nozzle 13*c*-1 is arranged in the most upstream side of the swirling flow, and the processing gas nozzle 13*c*-2, the fuel nozzle 13*a*, and the processing gas nozzle 13*c*-3 are arranged in this order toward the downstream side of the swirling flow with reference to the processing gas nozzle 13*c*-1 arranged in the most upstream side.

When a persistent gas or the like flows into the combustion chamber 1 as the processing gas, it is necessary to add oxygen to air of the combustion supporting gas and form a high temperature field. In this case, the upper set has the same configuration as the set of FIGS. 15A and 15B, the lower set has the set shown in FIGS. 17A and 17B in which the combustion supporting gas nozzles 13*b* are removed from the set shown in FIGS. 13A and 13B, and the combustion supporting gas nozzles 13*b* are provided to only the upper set.

A flame forming position moves to a more upstream side of the swirling than in a case where the lower set shown in FIGS. 16A and 16B is used, and the flame volume can be reduced, so that it is possible to form a higher temperature field.

In the combustion chamber 1 described above, the fuel gas, the combustion supporting gas, and the processing gas are blown at flow velocities higher than or equal to a combustion velocity of the flame. In this case, the flow velocities of the fuel gas, the combustion supporting gas, and the processing gas are adjusted so that the swirl number (a dimensionless number representing the degree of swirl) becomes 5 to 40. By adjusting the flow velocities of the fuel gas, the combustion supporting gas, and the processing gas based on the swirl number in this way, a desired cylindrical mixed flame can be formed. It is suitable that the pilot burner 12 forms a flame at all times in order to improve stability of the flame.

Figure 18:
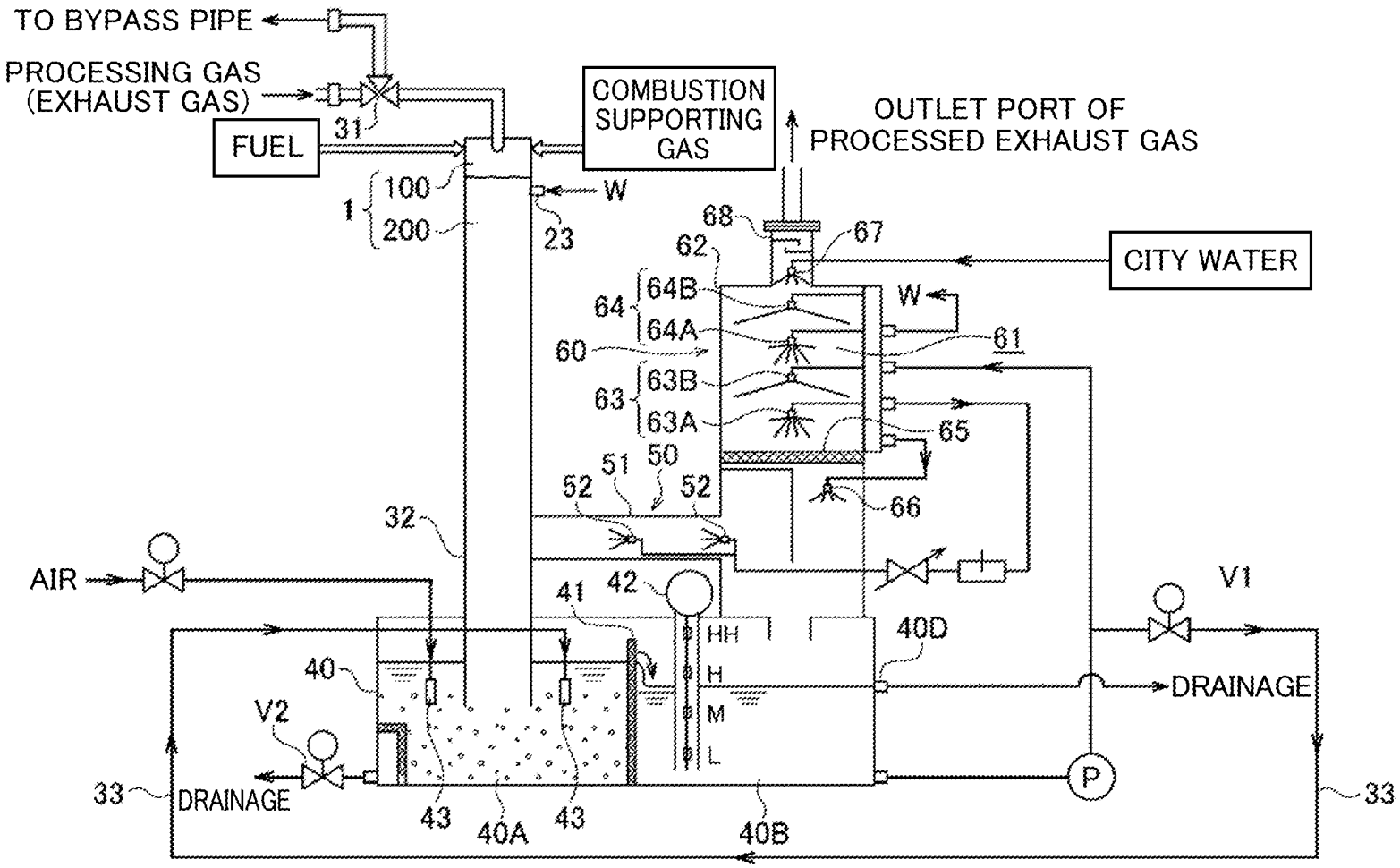
FIG. 18 is a schematic diagram showing an entire configuration of the exhaust gas processing apparatus including the combustion chamber 1.

FIG. 18 is a schematic diagram showing an entire configuration of the exhaust gas processing apparatus including the combustion chamber 1. As shown in FIG. 18, the exhaust gas processing apparatus includes the combustion chamber 1 that combusts and oxidatively decomposes the processing gas (exhaust gas), and a circulating water tank 40 and an exhaust gas cleaning module 60 which are arranged on a post-stage of the combustion chamber 1.

The processing gas (exhaust gas) is supplied in the tangential direction of the inner circumferential surface of the burner head 100 in the combustion chamber 1 through a bypass valve (three-way valve) 31 (FIG. 18 schematically shows that the processing gas is supplied from an upper portion). When the exhaust gas processing apparatus has a failure, the bypass valve 31 is operated, and the processing gas is not introduced to the exhaust gas processing apparatus but sent to a bypass pipe not shown in FIG. 18. In the same manner, the fuel and the combustion supporting gas are also supplied in the tangential direction of the inner circumferential surface of the burner head 100.

When blowing the fuel, the combustion supporting gas, and the processing gas toward the tangential direction of the inner circumferential surface of the combustion chamber 1 at a flow velocity higher than or equal to aflame combustion speed, the three-type-mixed cylindrical mixed flame, which floats from the inner wall of the combustion chamber 1, is formed. Water W is supplied from the water supply nozzle 23 to an upper portion of the combustion chamber main body 200, and the water W flows down along an inner surface of the combustion chamber main body 200 and forms a wetted wall (water film). Powder such as $SiO_2$ generated by combustion of the processing gas is collected by the wetted wall water 23*a*.

The combustion chamber 1 extends downward through a connection pipe 32 and reaches the circulating water tank 40 arranged below. A weir 41 is provided inside the circulating water tank 40, and the circulating water tank 40 is divided into an upstream side first tub 40A and a downstream side second tub 40B by the weir 41. Powder product materials collected by the wetted wall water 23*a* fall into the first tub 40A in the circulating water tank 40 through the connection pipe 32 and are accumulated on a bottom portion of the first tub 40A. The wetted wall water 23*a* that flows down on the inner surface of the combustion chamber 1 flows into the first tub 40A. The water in the first tub 40A overflows the weir 41 and flows into the second tub 40B.

The combustion chamber 1 communicates with the exhaust gas cleaning module 60 through a cooling module 50. The cooling module 50 has a pipe 51 extending to the connection pipe 32 and a spray water supply nozzle 52 arranged in the pipe 51. The spray water supply nozzle 52 sprays water against the exhaust gas flowing through the pipe 51. Therefore, the exhaust gas processed in the combustion chamber 1 is cooled by the water splayed from the spray water supply nozzle 52. The splayed water is collected to the circulating water tank 40 through the pipe 51.

The cooled exhaust gas is next introduced to the exhaust gas cleaning module 60. The exhaust gas cleaning module 60 cleans the exhaust gas by water and removes fine dust contained in the exhaust gas. The dust is mainly powder product materials generated by oxidization decomposition (combustion processing) in the combustion chamber 1.

The exhaust gas cleaning module 60 includes a wall member 62, which configures a gas flow path 61, and further includes a first mist nozzle 63A, a first water film nozzle 63B, a second mist nozzle 64A, and a second water film nozzle 64B, which are arranged in the gas flow path 61. The mist nozzles 63A and 64A and the water film nozzles 63B and 64B are located at a central portion of the gas flow path 61 and substantially linearly aligned. The first mist nozzle 63A and the first water film nozzle 63B configure a first nozzle unit 63, and the second mist nozzle 64A and the second water film nozzle 64B configure a second nozzle unit 64. Therefore, in the present embodiment, two nozzle units 63 and 64 are provided. The number of the nozzle units may be one, and three or more nozzle units may be provided.

The first mist nozzle 63A is arranged on the upstream side of the first water film nozzle 63B in an exhaust gas flowing direction. In the same manner, the second mist nozzle 64A is arranged on the upstream side of the second water film nozzle 64B. In other words, the mist nozzles and the water film nozzles are alternatively arranged. The mist nozzles 63A and 64A, the water film nozzles 63B and 64B, and the wall member 62 are composed of a corrosion-resistant resin (for example, PVC: polyvinyl chloride).

A flow straightening member 65 that straightens the flow of exhaust gas is arranged on the upstream side of the first mist nozzle 63A. The flow straightening member 65 generates a pressure loss of the exhaust gas and uniforms the flow of exhaust gas in the gas flow path 61. The flow straightening member 65 is desired to be composed of a material other than metal in order to prevent corrosion due to acid. Examples of the flow straightening member 65 include a nonwoven material composed of resin and a resin plate where a plurality of open holes are formed. A mist nozzle 66 is arranged on the upstream side of the flow straightening member 65. The mist nozzles 63A, 64A, and 66 and the water film nozzles 63B and 64B are attached to the wall member 62.

The exhaust gas is introduced from the pipe 51 to the inside of the exhaust gas cleaning module 60. The exhaust gas flows from bottom to top in the exhaust gas cleaning module 60. More specifically, the exhaust gas introduced from the pipe 51 first proceeds to the mist nozzle 66 in the exhaust gas cleaning module 60. Then, the exhaust gas passes through mist formed by the mist nozzle 66 and is straightened by the flow straightening member 65. The exhaust gas that has passed through the flow straightening member 65 forms a uniform flow and rises in the gas flow path 61 at a low speed. In the gas flow path 61, mist, water film, mist, and water film are formed in this order.

The fine dust particles with a diameter of less than 1 μm contained in the exhaust gas are easily attached to water particles included in the mist by a diffusion action (Brownian motion) and thereby captured by the mist. Most of dust particles with a diameter of 1 μm or more are also captured by the water particle. The diameters of the water particles are about 100 μm, so that the size (diameter) of the dust particle attached to the water particle apparently becomes large. Therefore, a water particle containing a dust particle easily collides with a water film on the downstream side by inertial impaction, and the dust particle is removed from the exhaust gas along with the water particle. Dust particles with relatively large diameters that are not captured by the mist are also captured by the water film and removed. The exhaust gas cleaned by the water in this way is exhausted from an upper end portion of the wall member 62.

As shown in FIG. 18, the circulating water tank 40 described above is located below the exhaust gas cleaning module 60. The water supplied from the mist nozzles 63A, 64A, and 66 and the water film nozzles 63B and 64B is collected to the second tub 40B of the circulating water tank 40. The water stored in the second tub 40B is supplied to the mist nozzles 63A, 64A, and 66 and the water film nozzles 63B and 64B by a circulating water pump P. At the same time, the circulating water is sent to the water supply nozzle 23 as the water 81, and as described above, the water W forms the wetted wall water 23*a* on the inner surface of the combustion chamber main body 200 in the combustion chamber 1.

The water supplied to the mist nozzles 63A and 64A and the water film nozzles 63B and 64B is the water collected to the circulating water tank 40 and contains dust (powder product materials and the like). Therefore, city water is supplied from a shower nozzle 67 to the gas flow path 61 to clean the gas flow path 61. A mist trap 68 is provided above the shower nozzle 67. The mist trap 68 has a plurality of baffle plates inside thereof and can capture the mist. The exhaust gas that is processed and detoxified in this way is finally discharged to the atmosphere through an exhaust duct.

The circulating water tank 40 is provided with a water level sensor 42. The water level sensor 42 monitors water level of the second tub 40B, so that it is possible to control the water level of the second tub 40B within a predetermined range. Some of the water transferred by the circulating water pump P is supplied to a plurality of eductors 43 installed in the circulating water tank 40 through a water supply pipe 33. An open-close valve V1 is installed in the water supply pipe 33. It is possible to supply water to the eductors 43 by opening the open-close valve V1. The circulating water tank 40 is provided with a drain valve V2 for draining away water from the circulating water tank 40.

The water in the circulating water tank 40 is pressurized and supplied to each educator 43 by the circulating water pump P. By using pressure drop generated when a nozzle of each eductor 43 throttles the flow of water, the water in the circulating water tank 40 is sucked into the eductor 43 from a suction port of the eductor 43. The sucked water is injected from a discharge port of the eductor 43 to a bottom portion of the circulating water tank 40 along with the water discharged from the nozzle of the eductor 43. Powder located on the bottom portion of the circulating water tank 40 is crushed and floated by an injection impact force of the injected water injected from the discharge port of the eductor 43, and the powder is automatically discharged from a drain port 40D of the circulating water tank 40 along with drainage water.

As described above, in the present embodiment, the combustion chamber 1 of the exhaust gas processing apparatus is composed of the burner head 100 and the combustion chamber main body 200. Therefore, maintenance can be performed easily.

REFERENCE SIGNS LIST 1 combustion chamber
11 chassis
11*a* cylindrical portion
11*a*3 hole
11*b* annular portion
11*b*1 fastening module
11*b*2, 11*b*3 opening
11*b*4 circular groove
11*b*5 purge gas blowing module
11*c* ceiling module
11*c*1 hole
11*d* projecting module
11*d*1 fuel supply nozzle
11*d*2 air supply nozzle
12 pilot burner
13*a* fuel nozzle
13*b* combustion supporting gas nozzle

13*c* processing gas nozzle
13*d* purge gas nozzle
13*e* processing gas nozzle purge gas introduction nozzle
14*a* bolt
14*b* nut
15*a* to 15*c* opening
100 burner head
21 upper cylindrical portion
21*a* fastening module
21*b* bottom plate
21*c* side plate
22 lower cylindrical portion
23 water supply nozzle
23*a* wetted wall water
200 combustion chamber main body
31 bypass valve
32 connection pipe
33 water supply pipe
40 circulating water tank
40A, 40B tub
41 weir
42 water level sensor
43 eductor
50 cooling module
51 pipe
52 spray nozzle
60 exhaust gas cleaning module
61 gas flow path
62 wall member
63A, 64A, 66 mist nozzle
63B, 64B water film nozzle
63, 64 nozzle unit
65 straightening member
67 shower nozzle
68 mist trap

What is claimed is:

1. A burner head that constitutes a combustion chamber for an exhaust gas processing apparatus by being attached to an upper portion of a combustion chamber main body, the burner head comprising:

a chassis which comprises a cylindrical portion with a lower opening, a fastening module for removably fastening to the combustion chamber main body being provided in the chassis;

a fuel nozzle that blows fuel into the cylindrical portion;

a combustion supporting gas nozzle that blows combustion supporting gas into the cylindrical portion;

a processing gas nozzle that blows processing gas into the cylindrical portion; and a pilot burner that ignites the fuel and/or the combustion supporting gas, wherein the fuel nozzle, the combustion supporting gas nozzle, and the processing gas nozzle are located on an identical plane perpendicular to an axis line of the cylindrical portion.

2. A burner head that constitutes a combustion chamber for an exhaust gas processing apparatus by being attached to an upper portion of a combustion chamber main body, the burner head comprising:

a chassis which comprises a cylindrical portion with a lower opening, a fastening module for removably fastening to the combustion chamber main body being provided in the chassis;

a fuel nozzle that blows fuel into the cylindrical portion;

a combustion supporting gas nozzle that blows combustion supporting gas into the cylindrical portion;

a processing gas nozzle that blows processing gas into the cylindrical portion; and a pilot burner that ignites the fuel and/or the combustion supporting gas, wherein a side surface of the cylindrical portion is provided with a first opening to which the fuel nozzle is connected, a second opening to which the combustion supporting gas nozzle is connected, and a third opening to which the processing gas nozzle is connected, and at least a part of the first opening, at least a part of the second opening, and at least a part of the third opening are located on an identical plane perpendicular to an axis line of the cylindrical portion.

3. The burner head according to claim 1, wherein a side surface of the cylindrical portion is provided with a third opening to which the processing gas nozzle is connected, and the third opening has a slit-like shape extending in a longitudinal direction of the cylindrical portion.

4. The burner head according to claim 1, wherein the pilot burner is removable from the cylindrical portion.

5. The burner head according to claim 1, wherein the cylindrical portion is provided with a hole which opens upward and into which a heater can be inserted.

6. The burner head according to claim 1, wherein the fastening module is welded to the chassis.

7. The burner head according to claim 1, wherein the fuel nozzle, the combustion supporting gas nozzle, and the processing gas nozzle are welded to the cylindrical portion.

8. The burner head according to claim 1, wherein the cylindrical portion is composed of a pipe.

9. The burner head according to claim 1, wherein the chassis comprises the cylindrical portion and an annular portion fitted to the cylindrical portion, and the fastening module projects outward from a side surface of the annular portion.

10. The burner head according to claim 1, further comprising:

a purge gas nozzle that blows purge gas into the cylindrical portion.

11. The burner head according to claim 10, wherein the chassis comprises the cylindrical portion and an annular portion fitted to the cylindrical portion, and the purge gas nozzle blows the purge gas into the cylindrical portion through an opening of the annular portion.

12. A burner head that constitutes a combustion chamber for an exhaust gas processing apparatus by being attached to an upper portion of a combustion chamber main body, the burner head comprising:

a chassis which comprises a cylindrical portion with a lower opening, a fastening module for removably fastening to the combustion chamber main body being provided in the chassis;

a fuel nozzle that blows fuel into the cylindrical portion;

a combustion supporting gas nozzle that blows combustion supporting gas into the cylindrical portion;

a processing gas nozzle that blows processing gas into the cylindrical portion; and a pilot burner that ignites the fuel and/or the combustion supporting gas, wherein the fuel, the combustion supporting gas, and the processing gas are blown toward a tangential direction of an inner circumferential surface of the cylindrical portion.

13. A combustion chamber for an exhaust gas processing apparatus, the combustion chamber comprising:

a combustion chamber main body; and the burner head according to claim 1, which is removably fastened to an upper portion of the combustion chamber main body.

14. A maintenance method of a combustion chamber for an exhaust gas processing apparatus, the combustion chamber comprising:

a combustion chamber main body; and the burner head according to claim 1, which is removably fastened to an upper portion of the combustion chamber main body, the maintenance method comprising:

removing the burner head from the combustion chamber main body; and fastening a new burner head according to claim 1 to the combustion chamber main body.

15. A manufacturing method of a combustion chamber for an exhaust gas processing apparatus, the manufacturing method comprising:

removably fastening the burner head according to claim 1 to an upper portion of the combustion chamber main body.

* * * * *